US005164771A

United States Patent [19]

Suzuki et al.

[11] Patent Number: 5,164,771

[45] Date of Patent: Nov. 17, 1992

[54] IMAGE FORMING APPARATUS WHICH ADJUSTS ILLUMINATION LEVELS INDEPENDENTLY FOR TEST SAMPLES AND FOR ORIGINALS

[75] Inventors: Koji Suzuki, Yokohama; Yoshikazu Yokomizo, Kawagoe; Yoshihiro Kawatsura, Kawasaki; Shinkichi Takahashi, Yokohama; Hiroaki Tsuchiya, Tokyo; Shinichi Iwasaki, Yokohama, all of Japan

[73] Assignee: Canon Kabushiki Kaisha, Tokyo, Japan

[21] Appl. No.: 675,053

[22] Filed: Mar. 25, 1991

Related U.S. Application Data

[63] Continuation of Ser. No. 313,306, Feb. 21, 1989, abandoned, which is a continuation of Ser. No. 24,928, Mar. 12, 1987, abandoned, which is a continuation of Ser. No. 369,676, Apr. 19, 1982, abandoned, which is a continuation of Ser. No. 68,416, Aug. 21, 1979, abandoned.

[30] Foreign Application Priority Data

| | | | |
|---|---|---|---|
| Aug. 24, 1978 | [JP] | Japan | 63-103036 |
| Aug. 24, 1978 | [JP] | Japan | 63-103037 |
| Aug. 24, 1978 | [JP] | Japan | 63-103040 |

[51] Int. Cl.[5] ..... G03G 15/02; G03G 15/04; G03G 21/00

[52] U.S. Cl. ..... 355/208; 355/69; 355/214; 355/219

[58] Field of Search ..... 355/204, 208, 214, 216, 355/219, 69

[56] References Cited

U.S. PATENT DOCUMENTS

| | | | |
|---|---|---|---|
| 3,321,307 | 5/1967 | Urbach | 355/216 X |
| 3,604,925 | 9/1971 | Snelling et al. | 355/216 X |
| 3,699,388 | 10/1972 | Ukai | 361/229 |
| 3,788,739 | 1/1974 | Coriale | 355/210 |
| 3,805,069 | 4/1974 | Fisher | 361/229 X |
| 3,892,481 | 7/1975 | Schaefer et al. | 355/208 X |
| 3,950,680 | 4/1976 | Michaels et al. | 317/262 A |
| 3,976,374 | 8/1976 | Hickman | 355/228 |
| 4,019,102 | 4/1977 | Wallot | 355/219 X |
| 4,028,596 | 6/1977 | Weber | 361/235 |
| 4,063,154 | 12/1977 | Andrus et al. | 355/219 X |
| 4,063,155 | 12/1977 | Buchheit | 355/219 X |
| 4,082,445 | 4/1978 | Steiner | 355/246 |
| 4,087,171 | 5/1978 | Yano | 355/214 X |
| 4,105,324 | 8/1978 | Seil | 355/208 |
| 4,138,635 | 2/1979 | Quinn | 323/21 |
| 4,140,962 | 2/1979 | Quinn | 355/221 |
| 4,141,646 | 2/1979 | Soma et al. | 355/246 |
| 4,153,364 | 5/1979 | Suzuki et al. | 355/214 |
| 4,166,690 | 9/1979 | Bacon et al. | 355/225 |
| 4,213,693 | 7/1980 | Imai et al. | 355/265 |
| 4,215,930 | 8/1980 | Miyakawa et al. | 355/208 |
| 4,306,804 | 12/1981 | Sakamoto et al. | 355/210 |
| 4,358,520 | 11/1982 | Hirayama | 430/54 |

FOREIGN PATENT DOCUMENTS

| | | | |
|---|---|---|---|
| 1023791 | 1/1978 | Canada | 314/39 |
| 2101399 | 7/1971 | Fed. Rep. of Germany . | |
| 2359532 | 7/1974 | Fed. Rep. of Germany . | |
| 2611503 | 11/1976 | Fed. Rep. of Germany . | |
| 1522619 | 2/1977 | Fed. Rep. of Germany . | |
| 2659021 | 7/1977 | Fed. Rep. of Germany . | |
| 2723673 | 12/1977 | Fed. Rep. of Germany . | |
| 2741713 | 3/1978 | Fed. Rep. of Germany . | |
| 2805471 | 8/1978 | Fed. Rep. of Germany . | |
| 1555341 | 11/1979 | United Kingdom . | |

*Primary Examiner*—Fred L. Braun

*Attorney, Agent, or Firm*—Fitzpatrick, Cella, Harper & Scinto

[57] ABSTRACT

An image forming apparatus includes a detector for measuring the surface potential of a photosensitive member on which an electrostatic latent image is formed and a controller which regulates image formation plural times in accordance with the measured surface potential based on the length of time between image formations. In another aspect, the image forming apparatus includes a light source and a setting device for manually setting the quantity of light therefrom between a maximum and minimum value. A test sample of a predetermined optical density is arranged to be illuminated by the light source so as to produce a test light for projection onto a recording medium. A detector detects an electrical surface condition of the test-lighted recording medium. In response to the detected electrical surface conditions, and a controller regulates the image formation in accordance with the detector. The light from the light source is adjusted so that illumination of the test sample assumes a standard value intermediate the maximum and minimum values, and so that illumination of an original assumes the value set by the setting device.

27 Claims, 17 Drawing Sheets

IMAGE FORMING APPARATUS WHICH ADJUSTS ILLUMINATION LEVELS INDEPENDENTLY FOR TEST SAMPLES AND FOR ORIGINALS

This application is a continuation of application Ser. No. 07/313,306 filed Feb. 21, 1989, now abandoned, which was a continuation of application Ser. No. 024,928 filed Mar. 12, 1987, now abandoned, which was a continuation of Ser. No. 369,676 filed Apr. 19, 1982, now abandoned, which in turn was a continuation of Ser. No. 68,416, filed on Aug. 21, 1979, now abandoned.

BACKGROUND OF THE INVENTION

1. Field of the Invention

This invention relates to an electrostatic recording apparatus in which an electrostatic latent image is formed on a recording medium and the latent image is developed to form a visible image, and more particularly relates to an electrostatic recording apparatus provided with a surface potentiometer for detecting the surface potential of the recording medium.

2. Description of the Prior Art

Several methods of controlling the surface potential of the recording medium of an electrostatic recording apparatus to be a constant value have heretofore been proposed. For example, there is a method of controlling the voltage applied to a corona discharging device by the detection output of detector means which detects the surface potential, but according to such method, it has been impossible to correct any variation in surface potential which is caused by a variation in corona current which in turn is caused by a temporary variation in temperature and humidity or a variation in the source voltage of the corona discharging device.

There is also a method which uses a constant current circuit to maintain the corona current value constant, whereas according to this method, it has been impossible to cause the same potential to be produced on a photosensitive medium due to deterioration of the photosensitive medium and variations in other characteristics with time even if the corona current value is constant, and accordingly it has not been possible to maintain the surface potential at a proper value.

Also, in an electrostatic recording apparatus using the conventional surface potentiometer, when the detection output of the detector means which detects the surface potential is held for a long time, it has been impossible to form a stable image because of a variation in the holding voltage with time.

It has also been difficult to bring the potential on a recording medium to an ideal value by one detection output of the surface potential due to variations in charging conditions such as variations in environmental conditions, deterioration of the discharging device, deterioration of the drum, etc. It has therefore been impossible to form a stable image based on the detection of the surface potential.

Also, carrying out the detection of the surface potential by a surface potentiometer and the control by the detection output each time an image is formed leads to a great loss of time. When such detection and control are carried out for each predetermined time, accurate surface potential control has not been possible if temperature or humidity is varied within said predetermined time.

In the conventional electrostatic recording apparatus, there is a method whereby a bias is applied to a developing device as the developing means to control the developing device at a predetermined potential with respect to the latent image potential, whereas if the developing bias is maintained constant, irregularity occurs to the developer having a charge. Also, if the developing bias is constant with respect to a variation in the latent image potential, fog has been created in the background of the image.

Where a detector circuit detects an abnormally low surface potential due to the abnormality of the detector circuit which detects the surface potential of the recording medium, deterioration of the recording medium, damage of the discharging device, etc., the detector circuit tries to increase the output of the high voltage source to thereby enhance the surface potential, but if the output of the high voltage source becomes too great, the corona discharge may change into a glow discharge which may damage the surface of the recording medium or the high voltage source itself.

In the conventional electrostatic recording apparatus, one of the factors which make the recorded image unstable has been the deterioration of the recording medium. If the recording medium is deteriorated, it becomes impossible to accumulate on the recording medium a charge necessary to provide a stable image. However, in the conventional electrostatic recording apparatus, it has been impossible to confirm the deterioration of the recording medium.

SUMMARY OF THE INVENTION

It is an object of the present invention to provide an image formation apparatus which eliminates the above-noted disadvantages, and more particularly an electrostatic recording apparatus in which the surface potential of the photosensitive medium is maintained stable irrespective of variations in environmental conditions, deterioration of the photosensitive medium, stain of the corona discharge electrode, etc.

It is another object of the present invention to provide an electrostatic recording apparatus having a high voltage source for a charging coronal discharge device whose output is variable, detector means for detecting the surface potential of a recording medium, and control means for controlling the output of the high voltage source in accordance with the output of the detector means, characterized by setting means for repetitively effecting the detection by the detector means and the output control of the high voltage source and for re-setting the output of the high voltage source to the recording medium to a predetermined value at a predetermined time.

It is still another object of the present invention to provide an image formation apparatus in which the surface potential is detected a plurality of times to thereby gradually bring the surface potential of the photosensitive medium to an ideal value.

It is yet still another object of the present invention to provide an electrostatic recording apparatus in which the frequency of the control which controls the output of the high voltage source for the corona discharge device by the surface potential detection output in accordance with the down time during which the electrostatic recording apparatus has been left unused.

It is a further object of the present invention to provide an electrostatic recording apparatus provided with changeover means for changing over the voltage applied to the developing means, in accordance with the condition of latent image formation means for forming a latent image, characterized in that at least when the latent image is being developed, said applied voltage is controlled by the detection output of detector means which detects the surface potential of the photosensitive medium.

It is a further object of the present invention to provide an electrostatic recording apparatus in which the output of the high voltage source may be set to a predetermined value when the control by the surface potential detector means has become impossible. More particularly, it is an object of the present invention to provide an electrostatic recording apparatus provided with output limiting means for controlling the output of the high voltage source so that such output does not exceed a predetermined level, irrespective of the output of the detector means which detects the surface potential of the recording medium. It is also an object of the present invention to provide an electrostatic recording apparatus having control means for controlling the output of the high voltage source to a constant value irrespective of the output of the detector means.

It is a further object of the present invention to provide an electrostatic recording apparatus characterized in that deterioration of the recording medium is informed by the output of the detector means which detects the surface potential of the recording medium.

It is a further object of the present invention to provide an electrophotographic copying apparatus having an original exposure lamp for irradiating an original with light, the lamp being movable relative to the original, setting means for arbitrarily setting the quantity of light of the lamp, a photosensitive plate upon which the reflected light from the original is projected, and process means for applying various processes to the photosensitive plate, characterized in that a reflector plate having a predetermined density is provided at a portion which is irradiated by the lamp, the surface potential of that portion of the photosensitive plate which corresponds to the position of the reflector plate is measured by measuring means and the process means is controlled by the measurement output, and the lamp emits a predetermined quantity of light when it irradiates the reflector plate, and emits a quantity of light based on the setting means when it irradiates the original.

The invention will become more fully apparent from the following detailed description thereof taken in conjunction with the accompanying drawings.

DESCRIPTION OF THE PREFERRED EMBODIMENTS

Figure 1A:
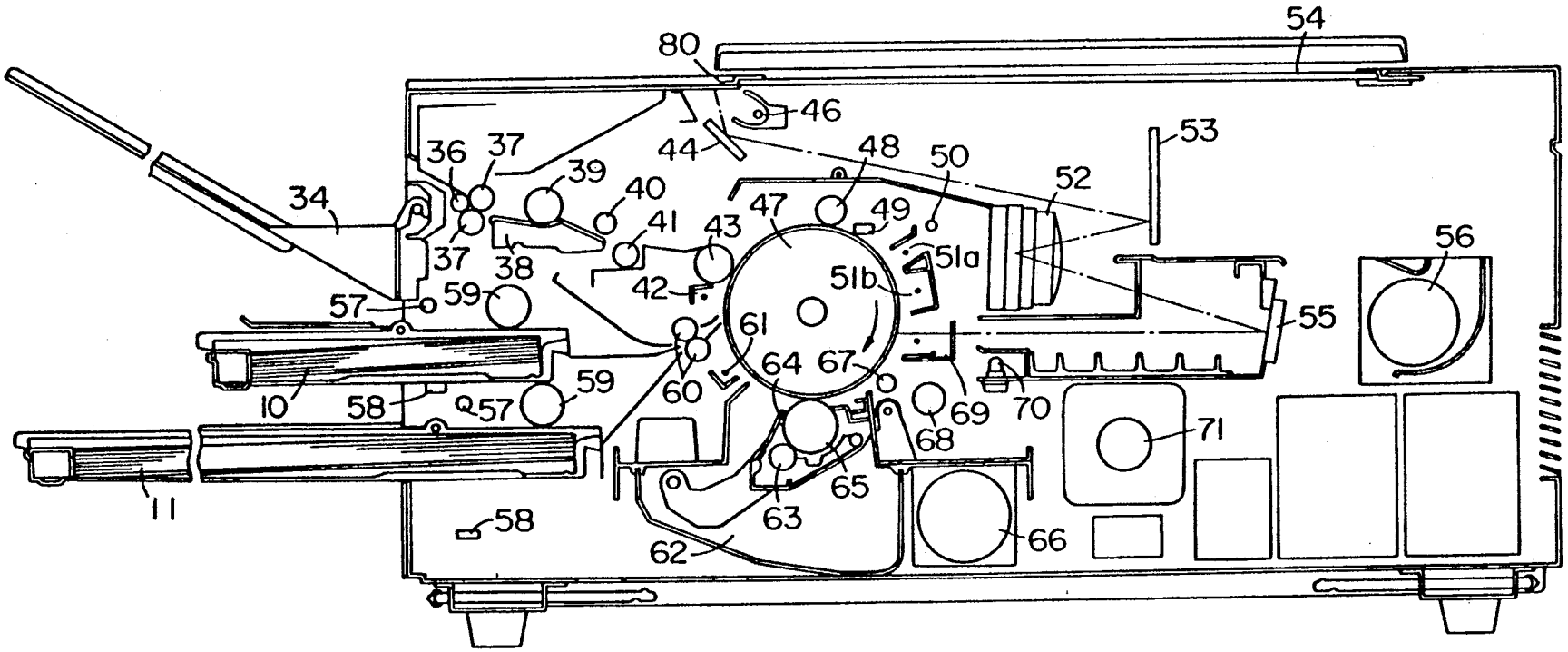
FIG. 1A is a cross-sectional view of a copying apparatus to which the present invention is applicable.

FIG. 1A is a cross-sectional view of a copying apparatus to which the present invention is applicable.

The surface of a drum 47 comprises a three-layer seamless photosensitive medium using a photoconductive member such as CdS. The drum is rotatably supported on a shaft and adapted to begin rotating in the direction of arrow by a main motor 71 which operates upon closing of a copy key.

When the drum 47 is rotated through a predetermined angle, an original placed on an original carriage glass 54 is illuminated by an illuminating lamp 46 integrally formed with a first scanning mirror 44 and the light reflected from the original is scanned by the first mirror 44 and a second mirror 53. The first mirror 44 and the second mirror 53 are moved at a velocity ratio of 1:½, whereby the original is scanned with the length of the optical path forward of a lens 52 always maintained constant.

The reflected light image is passed via a third mirror 55 and then focused onto the drum 47 at an exposure station.

The drum 47 is discharged by a pre-exposure lamp 50 and an AC precharger **51*a*, whereafter it is corona-charged (for example, to the positive (+) polarity) by a primary charger 51*b*. Thereafter, the drum 47 is slit-exposed to the image illuminated by the original exposure lamp 46**, at the aforementioned exposure station.

At the same time, the drum 47 is subjected to corona discharge by an AC charger 69 or by the polarity opposite to the primary charge (for example, the negative (−) charge), whereafter the drum is subjected to the uniform surface exposure by a whole surface exposure lamp 68, whereby an electrostatic latent image of high contrast is formed on the drum 47. The electrostatic latent image on the photosensitive drum 47 is liquid-developed into a visible toner image by the developing roller 65 of a developing device 62, and the toner image is made easy to be transferred by an image transfer pre-charger 61.

Transfer paper within an upper cassette 10 or a lower cassette 11 is fed into the machine by a paper feed roller 59, and is transported toward the photo-sensitive drum 47 with accurate timing inparted to the transfer paper by a set of register rollers 60 so that the leading end edge of the paper may be coincident with the leading edge of the latent image at an image transfer station.

Subsequently, the toner image on the drum 47 is transferred onto the transfer paper as it passes between an image transfer charger 42 and the drum 47.

After completion of the image transfer, the transfer paper is separated from the drum 47 by a separating roller 43 and transported to a conveyor roller 41 and directed between a heat plate 38 and keep rollers 39, 40 so that the transferred image on the transfer paper is fixed by pressure and heat, whereafter the transfer paper is discharged into a tray 34 by a set of discharge rollers 37 through a paper detecting roller 36.

After the image transfer, the drum 47 continues to rotate and has its surface cleaned by a cleaning device comprising a cleaning roller 48 and a resilient blade 49, thus becoming ready for another copying cycle.

A surface potentiometer 67 for measuring the surface potential is mounted adjacent to the surface of the drum 47 between the whole surface exposure lamp 68 and the developing device 62.

As a cycle preceding the above-described copying cycle, there is the step of pouring the developing liquid to the cleaning blade 49 with the drum 47 stopped after the main switch is closed. This step will hereinafter be referred to as the prewet. This is for causing the toner accumulated in the vicinity of the cleaning blade 49 to flow out and for imparting lubrication to the surface of contact between the blade 49 and the drum 47. After the prewet time (four seconds), there is a step in which the drum 47 is rotated and the residual charge and memory on the drum 47 are eliminated by the pre-exposure lamp 50 and the AC pre-discharger 51*a* and the drum surface is cleaned by the cleaning roller 48 and the cleaning blade 49. This will hereinafter be referred to as the pre-rotation. This is for rendering the sensitivity of the drum 47 proper and for forming an image on a clean surface. The prewet time and the time (number) of the pre-rotation are automatically varied by various conditions (as will hereinafter be described).

As a cycle succeeding to a set number of copying cycles, there is a step in which the drum 47 effects several full rotations during which the residual charge and memory on the drum are eliminated by the AC charger 69 and the drum surface is cleaned. This will hereinafter be referred to as the post-rotation LSTR. This is for leaving the drum 47 electro-statically and physically clean.

Figure 1B:
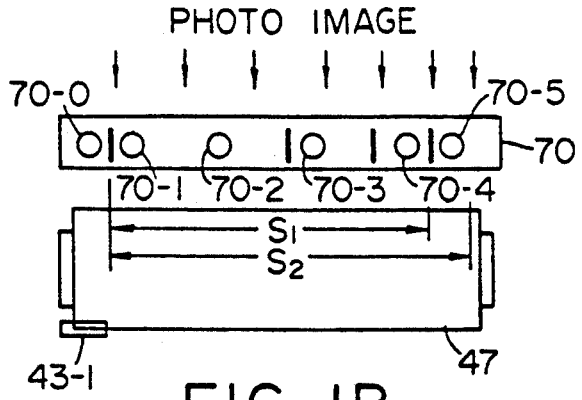
FIG. 1B is a plan view of the vicinity of blank exposure lamps 70.

FIG. 1B is a plan view of the neighborhood of the blank exposure lamps 70 of FIG. 1. The blank exposure lamps 70-1 to 70-5 are turned on during the rotation of the drum but during the other time than the exposure to eliminate the drum surface charge and thereby prevent any excess toner from adhering to the non-image area of the photosensitive drum 47. However, the blank exposure lamp 70-1 is for illuminating that part of the drum surface which corresponds to the surface potentiometer 67 and therefore, it is momentarily turned off when the dark part potential is measured by the surface potentiometer. In the B-size copying, the image area is smaller than A4 or A3 size and therefore, the blank exposure lamp 70-5 is turned on for the non-image area even during the forward movement of the optical system. The lamp 70-0 is what is called the sharp cut lamp and illuminates that portion of the drum which is in contact with the guide plate (not shown) of the separating roller 43, to thereby completely eliminate the charge in that portion and prevent adherence of the toner to the width portion of the drum which is available for the separation. This sharp cut lamp is turned on at all times during the rotation of the drum.

Figure 2:
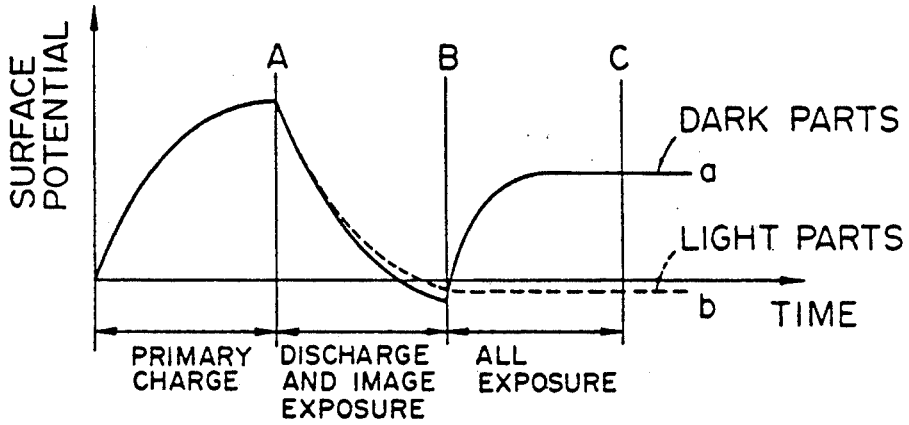
FIG. 2 is a graph illustrating the surface potentials in various parts of a photosensitive drum.
Figure 3:
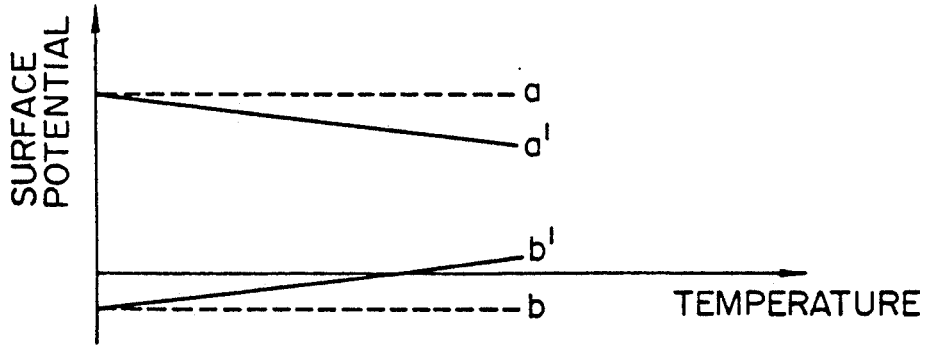
FIGS. 3 and 4 are graphs illustrating various in surface potential.
Figure 4:
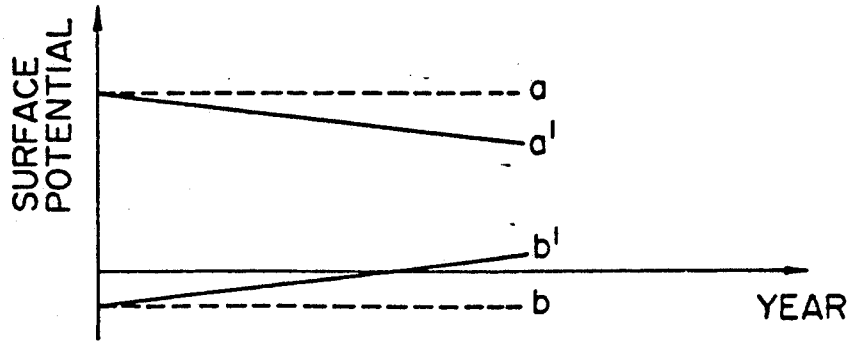

FIG. 2 illustrates how the surface potentials corresponding to the light parts of the original (the parts in which there is much reflection of light) and the dark parts (the parts in which there is little reflection of light) are varied at each process position of the copying process of such an electrophotographic copying apparatus. What is necessary as the final electrostatic latent image is the surface potential at point Ⓒ in FIG. 2, and when the ambient temperature of the photosensitive drum 47 has risen, the surface potentials (a) and (b) of the dark parts and the light parts are varied as indicated by (a)' and (b)' in FIG. 3 and are also varied as indicated by (a)' and (b)' in FIG. 4 for the variation with time of the photosensitive drum 47, so that the contrast between the dark parts and the light parts cannot be obtained.

Description will now be made in detail of a method of compensating for such variation in surface potential resulting from the temperature variation or the variation with time.

A surface potentiometer as the detector means for detecting the surface potential will first be explained.

Figure 5:
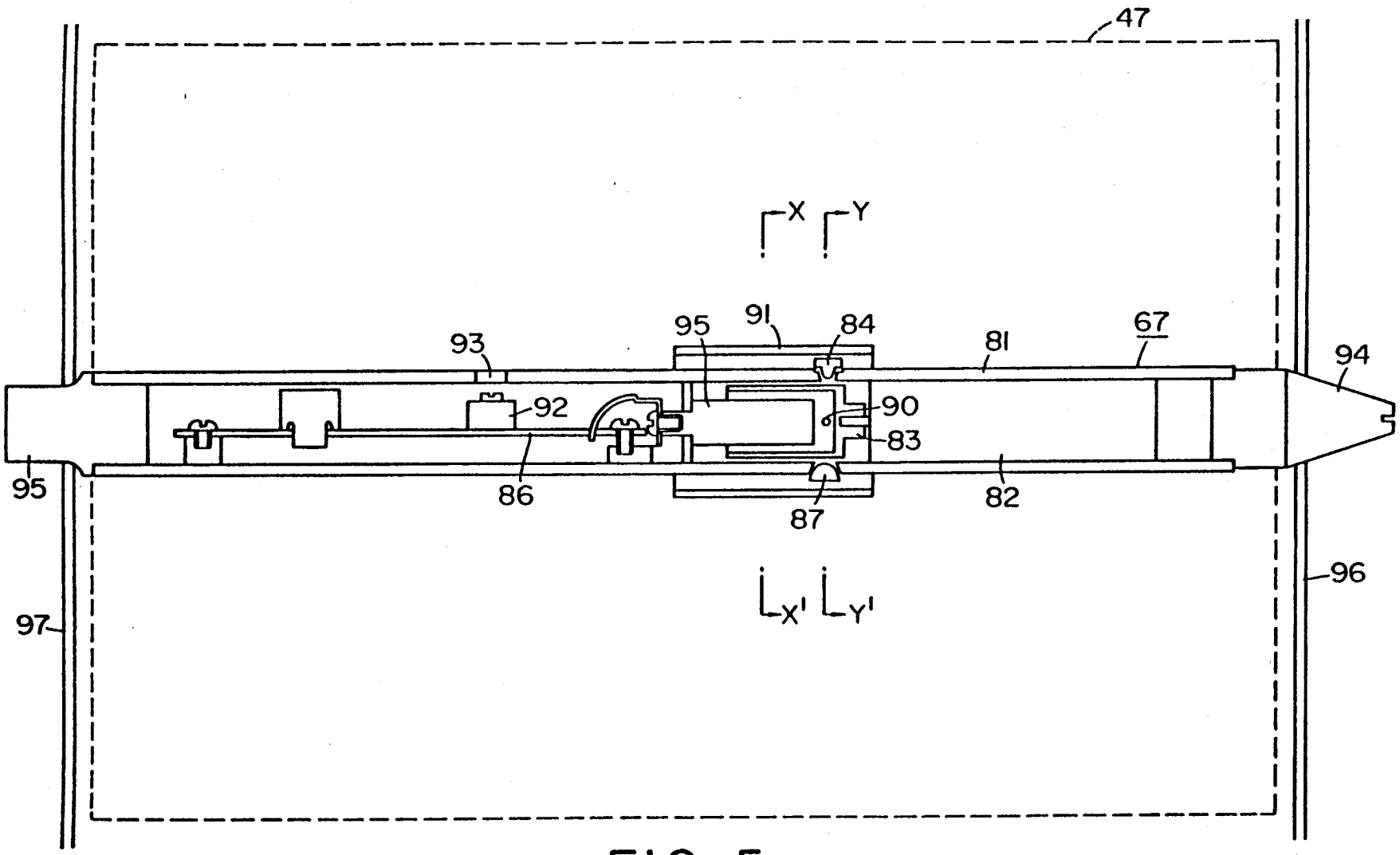
FIG. 5 is a side cross-sectional view of a surface potentiometer.
Figure 6:
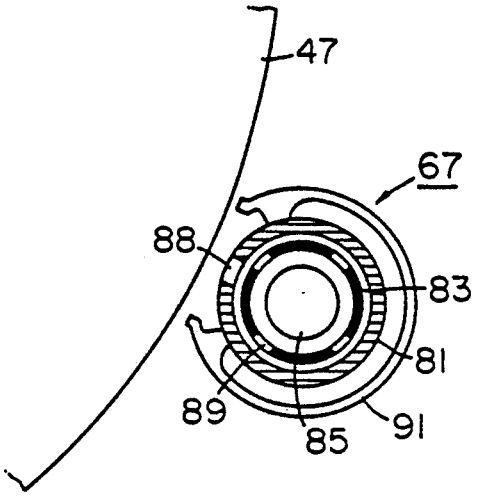
FIG. 6 is a cross-sectional view taken along line X—X' of FIG. 5.
Figure 7:
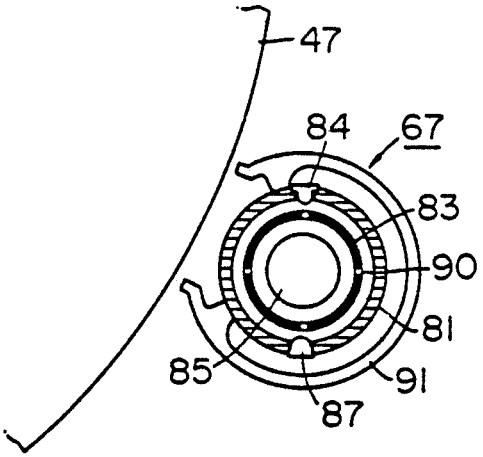
FIG. 7 is a cross-sectional view along line Y—Y' of FIG. 5.
Figure 8:
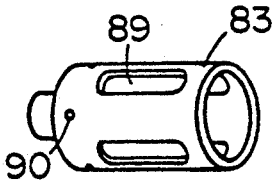
FIG. 8 is a perspective view of a cylindrical chopper.

FIG. 5 is a side cross-sectional view of the surface potentiometer, FIG. 6 is a cross-sectional view taken along line X—X' in FIG. 5, FIG. 7 is a cross-sectional view taken along line Y—Y' in FIG. 5, and FIG. 8 is a perspective view of a chopper as an intermittent interrupting means which will later be described.

In FIGS. 5, 6, 7 and 8, an outer cylinder 81 formed of brass has a surface charge detecting window 88. Designated by 82 is a motor as the drive means for rotating a chopper 83 which is cylindrically shaped and which has windows 90 for passing therethrough the light emitted by a light-emitting diode and a potential measuring window 89. Reference character 84 designates a light-emitting diode, 85 a surface charge measuring electrode, 86 a preamplifier print plate formed with a detecting circuit for detecting the output of the electrode 85, and 87 a phototransistor.

The surface potentiometer 67 is mounted at a position spaced apart by 2 mm from the drum surface which is the surface to be measured in such a manner that the surface charge detecting window 88 is opposed to the drum surface, and the preamplifier print plate 86 for amplifying the voltage detected by the electrode 85 is contained within the surface potentiometer and integrally formed therewith.

When a sensor motor drive signal SMD is put out by an unshown control circuit, a sensor motor 82 is driven to rotate the cylindrical chopper 83 so that the charge on the drum surface is induced in the electrode 85 through potential measuring windows 89.

Four potential measuring windows 89 are provided equidistantly on the chopper 83, and four windows 90 for passing therethrough the light emitted by the light-emitting diode are provided equidistantly intermediate the potential measuring windows 89. The voltage induced in the electrode 85 becomes an AC voltage because the chopper 83 is rotated to equidistantly interrupt the drum surface and the electrode 85. When the chopper 83 has interrupted the drum surface and the electrode 85, the phototransistor 87 receives the light from the light-emitting diode 84, and the output of the photo-transistor 87 is used as a synchronizing signal. Designated by 91 is a shield member for preventing entry of light from outside into the phototransistor 87. This shield member prevents dust or toner from entering into the interior of the surface potentiometer to adversely affect the measurement.

A variable resistor 92 for adjusting the gain of the surface potential detection output by changing the amplification factor of an amplifier mounted on the print plate 86 is adjustable by a driver or like means through an opening 93.

The surface potentiometer 67 is somewhat longer than the drum 47 and is mounted on side plates 96 and 97 which support the drum, by means of a positioning conical forward end 94 and a rearward end 95. The side plate 97 is removable.

Next, the surface potential control system will generally be described.

In the present embodiment, the blank exposure lamp 70-1, instead of the original exposure lamp 46 of FIG. 1, is used to detect the drum surface potentials of the light parts and the dark parts. The surface potential of the portion of the drum surface which is irradiated with the light from the blank exposure lamp 70-1 is measured as the surface potential of the light parts, and the surface potential of the portion of the drum surface which is not irradiated with the light from the blank exposure lamp 70-1 is measured as the surface potential of the dark parts.

The values of the light part potential and the dark part potential which can provide a proper image contrast are first set as the target values. In the present embodiment, the target light part potential $V_{LO}$ is set to $-100$ V and the target dark part potential $V_{DO}$ is set to $+500$ V. In the present embodiment, the surface potentials are controlled by controlling the current flowing to the primary charger 51*b* and the AC charger 69 and therefore, the charger standard current $I_{P1}$ and the AC charger standard current $I_{AC1}$ are assumed so that the light part potential and the dark part potential become the aforementioned target potentials $V_{LO}$ and $V_{DO}$, respectively. In the present embodiment, $$I_{P1}=350\ \mu A$$

and $$I_{AC1}=200\ \mu A.$$

The control procedures will now be described.

First, the surface potentials detected for the first time are determined as the light part potential $V_{L1}$ and the dark part potential $V_{D1}$ and how much difference exist between the light part potential $V_{L1}$ and the target light part potential $V_{LO}$ and between the dark part potential $V_{D1}$ and the target dark part potential $V_{DO}$ is judged. If the differential voltages are $\Delta V_{L1}$ and $\Delta V_{D1}$, $$\Delta V_{L1}=V_{LO}-V_{L1} \quad (1)$$

$$\Delta V_{D1}=V_{DO}-V_{D1} \quad (2)$$

The correction of the difference in light part potential is effected by the AC charger and the correction of the difference in dark part potential is effected by the primary charger, but actually, when the AC charger is controlled, not only the light part potential but also the dark part potential is affected. Likewise, when the primary charger is controlled, not only the dark part potential but also the light part potential is affected and therefore, a correction method which takes both the AC charger and the primary charger into consideration has been adopted.

The corrected current value $\Delta I_{P1}$ of the primary charger is:

$$\Delta I_{P1}\alpha_1\cdot\Delta V_{D1}+\alpha_2\cdot\Delta V_{L1} \quad (3)$$

where the setting coefficients $\alpha_1$ and $\alpha_2$ are the variations in current value of the primary charger when the surface potentials $V_D$ and $V_L$ have been varied, and may be represented as follows:

$$\alpha_1=\frac{\Delta I_P(\text{variation in primary charger current})}{\Delta V_D(\text{variation in dark part potential})} \quad (4)$$

$$\alpha_2=\frac{\Delta I_P(\text{variation in primary charger current})}{\Delta V_L(\text{variation in light part potential})} \quad (5)$$

On the other hand, the corrected current value $\Delta I_{AC1}$ of the AC charger is:

$$\Delta I_{AC1}=\beta_1\cdot\Delta V_{D1}+\beta_2\cdot\Delta V_{L1} \quad (6)$$

where the setting coefficients $\beta_1$ and $\beta_2$ may be represented as follows:

$$\beta_1=\frac{\Delta I_{AC}(\text{variation in AC charger current})}{\Delta V_D(\text{variation in dark part potential})} \quad (7)$$

$$\beta_2=\frac{\Delta I_{AC}(\text{variation in AC charger current})}{\Delta V_L(\text{variation in light part potential})} \quad (8)$$

Accordingly, the plus charger current $I_{P2}$ and the AC charger current $I_{AC2}$ after the first correction may be represented as follows:

From equations (4), (5) and (1), $$I_{P2}=\alpha_1\cdot\Delta V_{D1}+\alpha_2\cdot\Delta V_{L1}+I_{P1} \quad (9)$$

Likewise $$I_{AC2}=\beta_1\cdot\Delta V_{D1}+\beta_2\cdot\Delta V_{L1}+I_{AC1} \quad (10)$$

Here, the setting coefficients $\alpha_1$, $\alpha_2$, $\beta_1$ and $\beta_2$ are determined by predetermined charging conditions such as ambient temperature and humidity and condition of the corona charger and therefore, whether or not the surface potentials reach the target values by one control is unpredictable due to variations in environmental conditions and deterioration of the charger. For this reason, when the apparatus is in a predetermined condition, the surface potentials are measured a plurality of times and the control of the output of the corona discharging device is effected as often as the measurement. Since the second correction and so on are effected by the use of the same method as that used in the first correction, the current values $I_{Pn+1}$ and $I_{ACn+1}$ of the plus charger and the AC charger after the n th correction may be represented as follows:

$$I_{Pn+1} = \alpha_1 \cdot \Delta V_{Dn} + \alpha_2 \cdot \Delta V_{Ln} + I_{Pn} \quad (11)$$

$$I_{ACn+1} = \beta_1 \cdot \Delta V_{Dn} + \beta_2 \cdot \Delta V_{Ln} + I_{ACn} \quad (12)$$

Figure 9A:
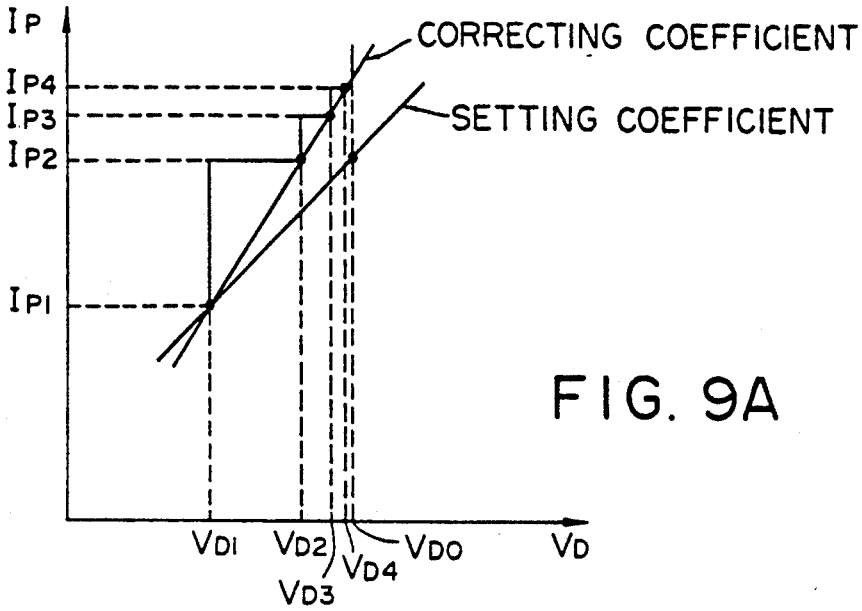
FIGS. 9A and 9B are graphs illustrating variations in dark part surface potential.
Figure 9B:
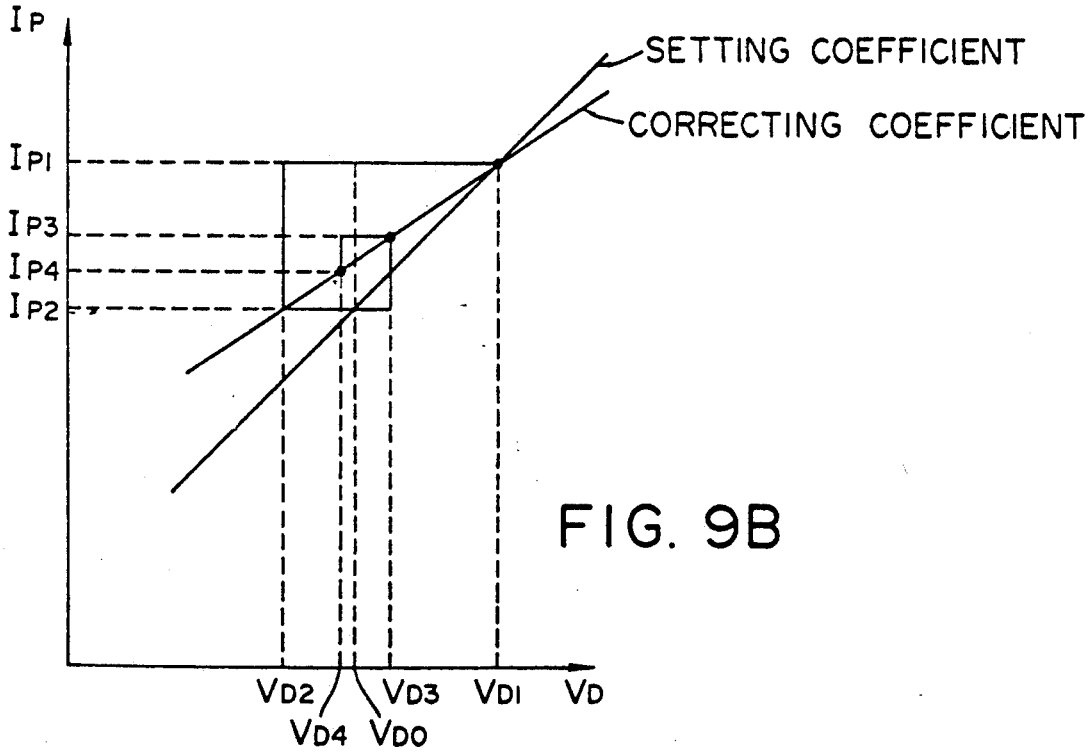

FIGS. 9A and 9B show the variations in dark part potential when the primary charger control current $I_P$ is corrected three times. FIG. 9A refers to the case where the setting coefficient is smaller than the actual correcting coefficient, and FIG. 9B refers to the case where the setting coefficient is greater than the actual correcting coefficient.

In the present embodiment, the number of times of correction has been set as shown in the table below.

| | Content | Number of times of correction |
|---|---|---|
| Condition 1 | the case where the copy start key is depressed within a first time of 30 seconds after completion of the previous copying | 0 |
| Condition 2 | the case where the copy start key is depressed within 30 seconds (the first time) to 30 minutes (a second time) after completion of the previous copying | 1 |
| Condition 3 | the case where the copy start key is depressed within 30 minutes to 5 hours (a third time) after completion of the previous copying | 2 |
| Condition 4 | the case where the copy start key is depressed after 5 hours after completion of the preious copying or after the main switch is closed | 4 |

By so setting, it is possible to better stabilize the surface potentials on the photosensitive medium and at the same time minimize the reduction in copying speed.

In condition 1, the previous control output current values of the primary charger and the AC charger are stored so that the primary charger and the AC charger are controlled by these values, and in condition 2, the previous control output current is flowed to the photosensitive medium to detect and control the surface potential. That is, in condition 2, the potential detection output before the copying is held so as to control the current flowing to the primary charger and the AC charger by the said potential detection output and the potential detection output after the copying.

However, in condition 3 and condition 4, the aforementioned standard current $I_{P1}$ is flowed to the photosensitive medium during the first correction measurement. That is, in condition 3 and condition 4, the control current during the previous cycle of copying is reset to the standard current, the surface potential is measured and the output current is controlled. Also, where the copying operation is effected for 30 minutes on end without the down time of more than 30 seconds intervening even a single time, one correction is effected when 30 minutes has elapsed.

This depends on the performance of the memory circuit which stores the control signal, and is attributable to the fact that the range within which the stored information of an analog memory (the integrating circuit of FIG. 14 which will later be described) is not lost is desirably 30 minutes or less from after the information is stored. When more than 30 minutes has elapsed, the stored information may sometimes be varied over 5% for the initial value and therefore, the surface potential is remeasured after the stored information is once reset.

Figure 10A:
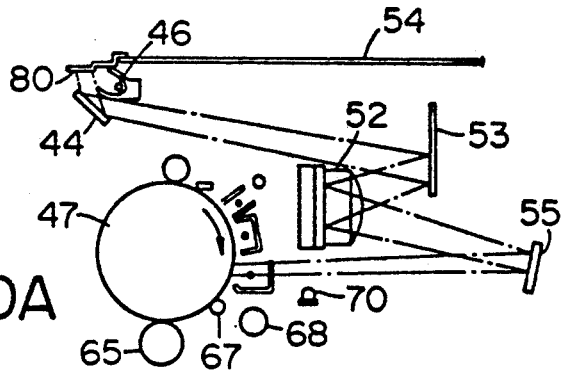
FIG. 10A is a schematic cross-sectional view of a copying apparatus concerned with developing bias control.

In the present embodiment, control of the developing bias voltage is further carried out. FIG. 10A is a schematic cross-sectional view for illustrating the same.

This is carried out in the manner as described below. Immediately before the original is exposed to light, a standard white plate 80 mounted near the original carriage glass 54 is illuminated by an original exposure halogen lamp 46 and the scattered reflected light resulting therefrom is projected upon the drum 47 via mirrors 44, 53, 55 and lens 52. The quantity of light so projected is called the standard quantity of light, which is always constant. The amount of exposure with which the original is actually exposed to light thereafter with a lamp 81 moved is changed to the amount of exposure arbitrarily set by the operator. The surface potentiometer 67 measures the surface potential $V_L$ of that portion of the drum 47 which is irradiated with said scattered reflected light, and the measured value $V_L$ plus 50 V is the developing bias voltage $V_H$.

By the developing bias voltage $V_H$, the potential of the toner is rendered substantially to the same level as the bias voltage and for example, when the standard light part potential, i.e., the said measured value $V_L$, is −100 V, the potential of the toner becomes −50 V and the toner and the drum repulse each other so that the toner does not adhere to the drum, thus preventing the fogging of the background portion of the original and ensuring stable development to be accomplished, which in turn leads to obtainment of stable images.

In the present embodiment, the standard white plate 80 corresponding to the white portion of a usual original is irradiated with the standard quantity of light and when the original is actually exposed to light, the amount of exposure is changed to the amount of exposure arbitrarily set by the operator and therefore, even where the background of the original is colored instead of white, the light part surface potential of the drum may be varied by the amount of exposure to obtain stable images.

Figures 10B, 11, 11A, 11B:
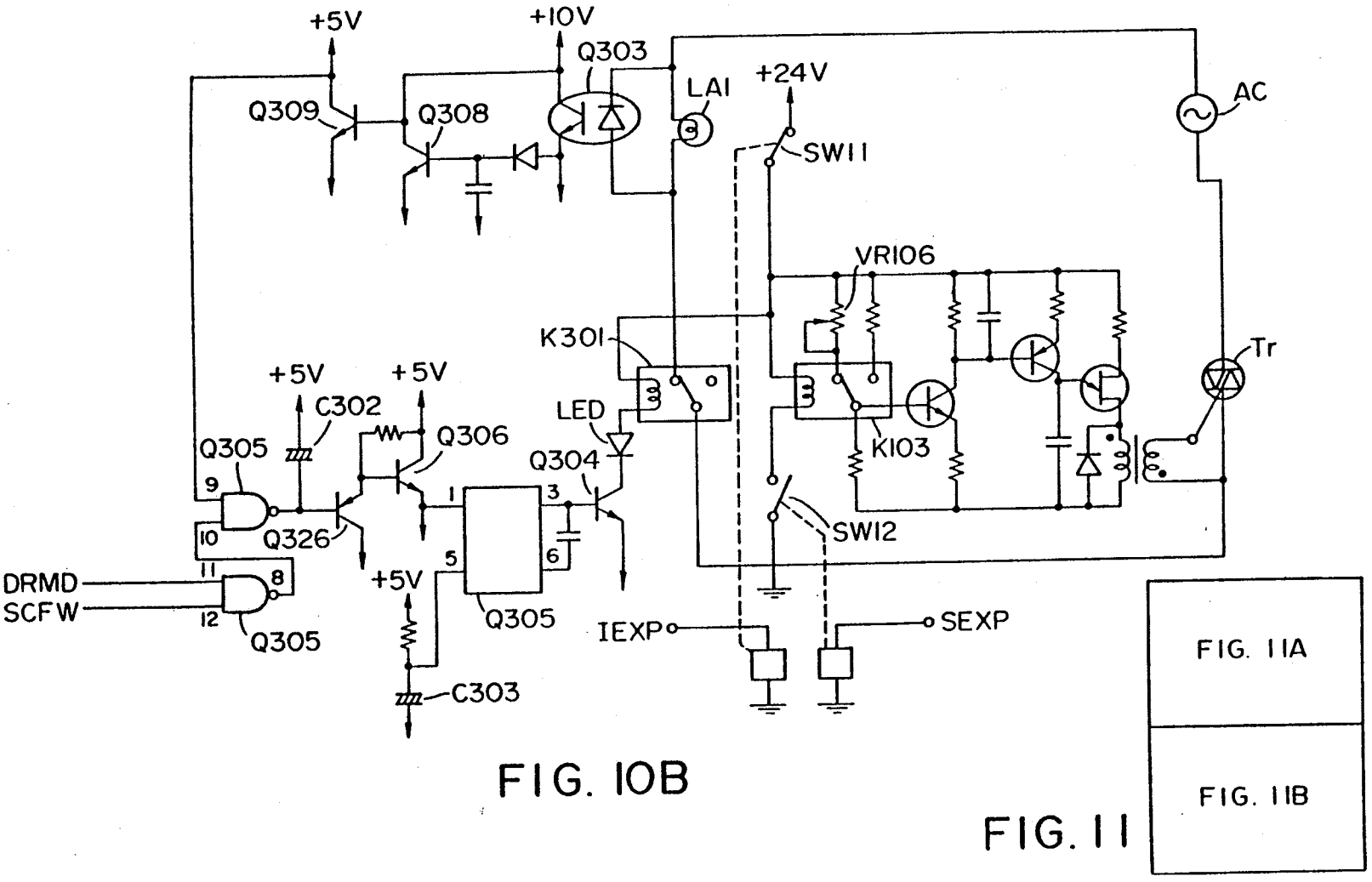
FIG. 10B is a diagram of a turn-on adjusting circuit for the original exposure lamp.
FIG. 11 comprising
FIGS. 11A and 11B, is a time chart of image formation and surface potential control.
Figure 11A:
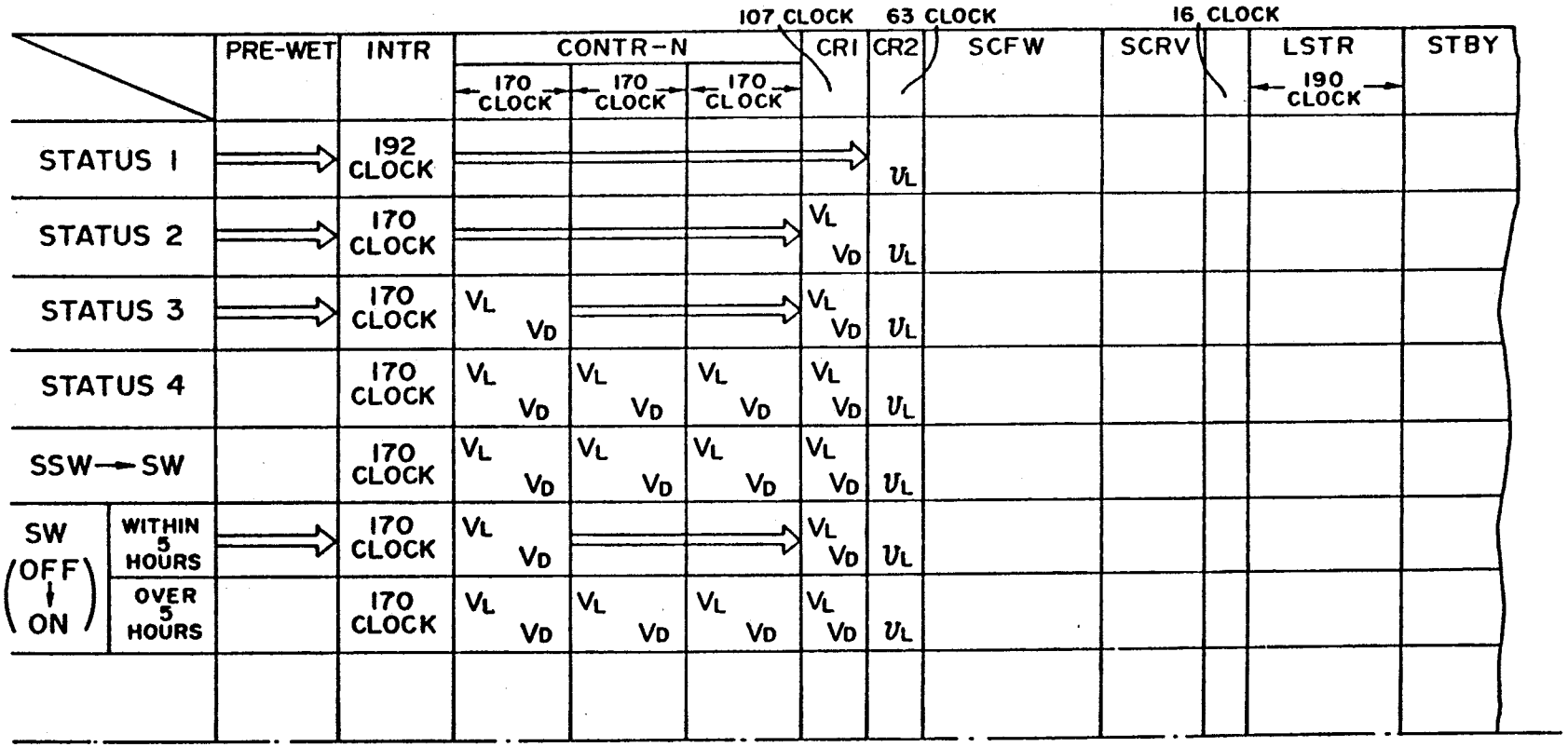
Figure 11B:
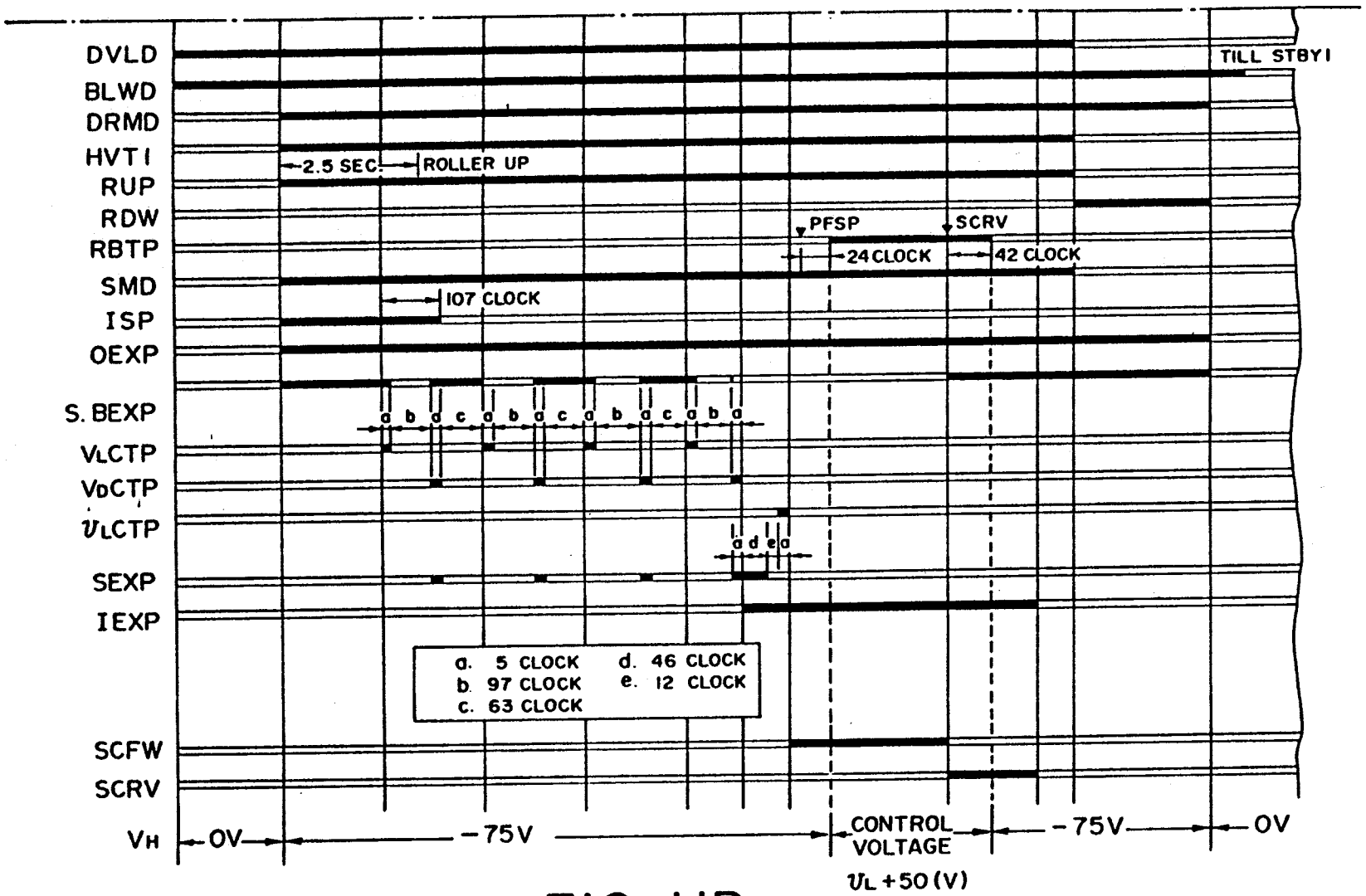

FIG. 10B shows a turn-on adjusting circuit for adjusting the quantity of light of the original exposure lamp 46. Designated by K301 is a relay which normally assumes the shown position and which, during abnormal condition, cuts off the power supply to a lamp LA1. When a switch SW11 is closed by a signal of timing output IEXP produced by an unshown DC controller, a triac Tr is operated to turn on the lamp. The timing therefor is shown in the time chart of FIGS. 11A and B. The present device adjusts the copy density by varying the quantity of light emitted by the lamp LA. For this purpose, the present device has a light adjusting circuit for varying the quantity of light by phase-controlling the triac Tr in accordance with the amount of displacement of a variable resistor VR106. The variable resistor VR106 has its resistance value variable between its maximum and minimum values in response to a density adjusting lever on the unshown operating panel of the apparatus.

The relay K103, when in the shown position, causes the resistor VR106 to effect the light adjusting operation and, when in the reverse position, adjust the light to the same quantity of light (standard quantity of light) as that when the density adjusting lever is brought to its intermediate position. When a switch SW12 is closed by the standard quantity-of-light signal SEXP, the light of this standard quantity is projected upon the standard white plate to measure the light part potential (on the photosensitive medium) and determine the bias voltage of the developing roller corresponding to the value of the light part potential.

Since the developing bias voltage $V_H$ is determined by applying light to the standard white plate 80 from the original exposure lamp actually used for the exposure, as described above, the accuracy of the control of the developing bias voltage is increased, and the copying speed is not reduced because the determination of the developing bias voltage $V_H$ takes place immediately before the exposure of the original. Further, during the exposure of the original, the amount of exposure is changed to the amount of exposure arbitrarily set by the operator and this leads to obtainment of stable images free of fog even where the background of the original is colored instead of white.

FIGS. 11A and B shows the time chart for effecting the above-described image formation and surface potential control.

In FIGS. 11A and B, INTR represents the pre-rotation for eliminating the residual charge on the drum and rendering the sensitivity of the drum proper and is executed always before the copying operation. CONTR-N represents the drum rotation for bringing the drum to its steady state in accordance with the down time thereof. During CONTR-N, the light part potential $V_L$ and the dark part potential $V_D$ are alternately measured by the surface potentiometer per full rotation of the drum to approximate the drum surface potential to the target value by the operation of a surface potential control circuit which will later be described. The detection of the surface potentials $V_D$ and $V_L$ is effected once for each full rotation of the drum, but it may of course be effected a plurality of times for each full rotation of the drum.

CR1 represents the drum rotation for detecting the light part potential $V_L$ and the dark part potential $V_D$ for 0.6 of one full rotation of the drum and controlling the corona charger.

CR2 represents the drum rotation immediately before the copying is started and during CR2, the light part potential is measured by the standard quantity of light from the original illuminating lamp to determine the bias value to the developing roller. This is executed always when the copying is started. SCFW represents the forward movement of the optical system. That is, this represents the rotation of the drum during the actual copying operation.

A control circuit for realizing the above-described surface potential control will hereinafter be described.

Figure 12A:
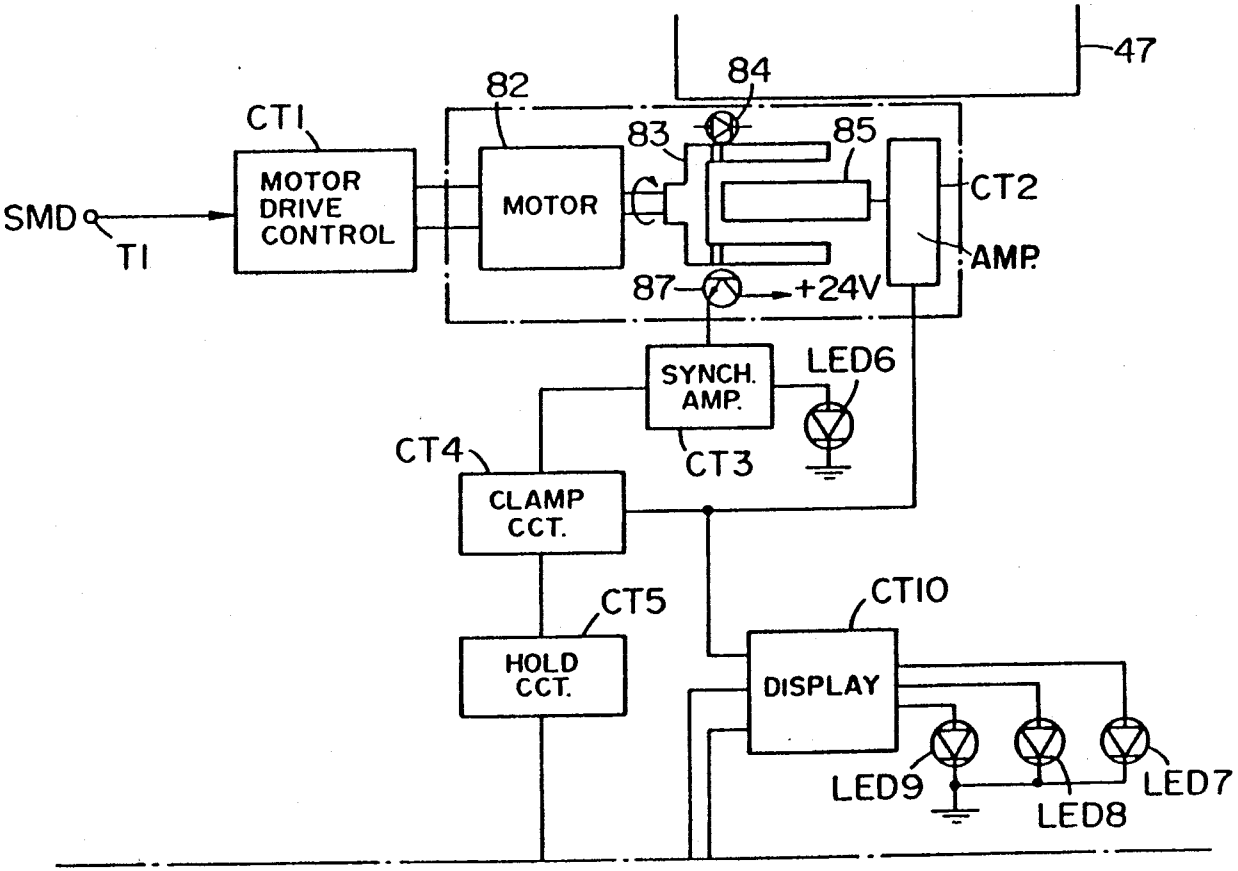
FIGS. 12A and 12B, is a diagram of a surface potential detecting and processing circuit.
Figure 12:
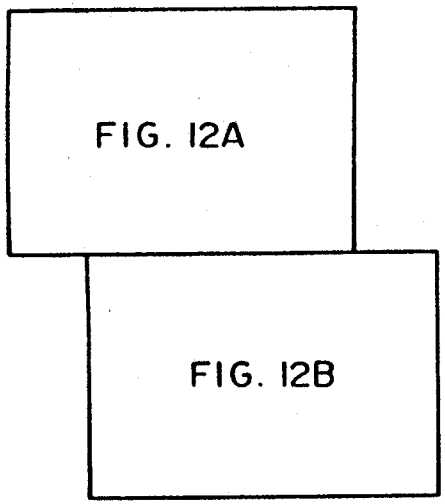
FIG. 12 comprising
Figure 12B:
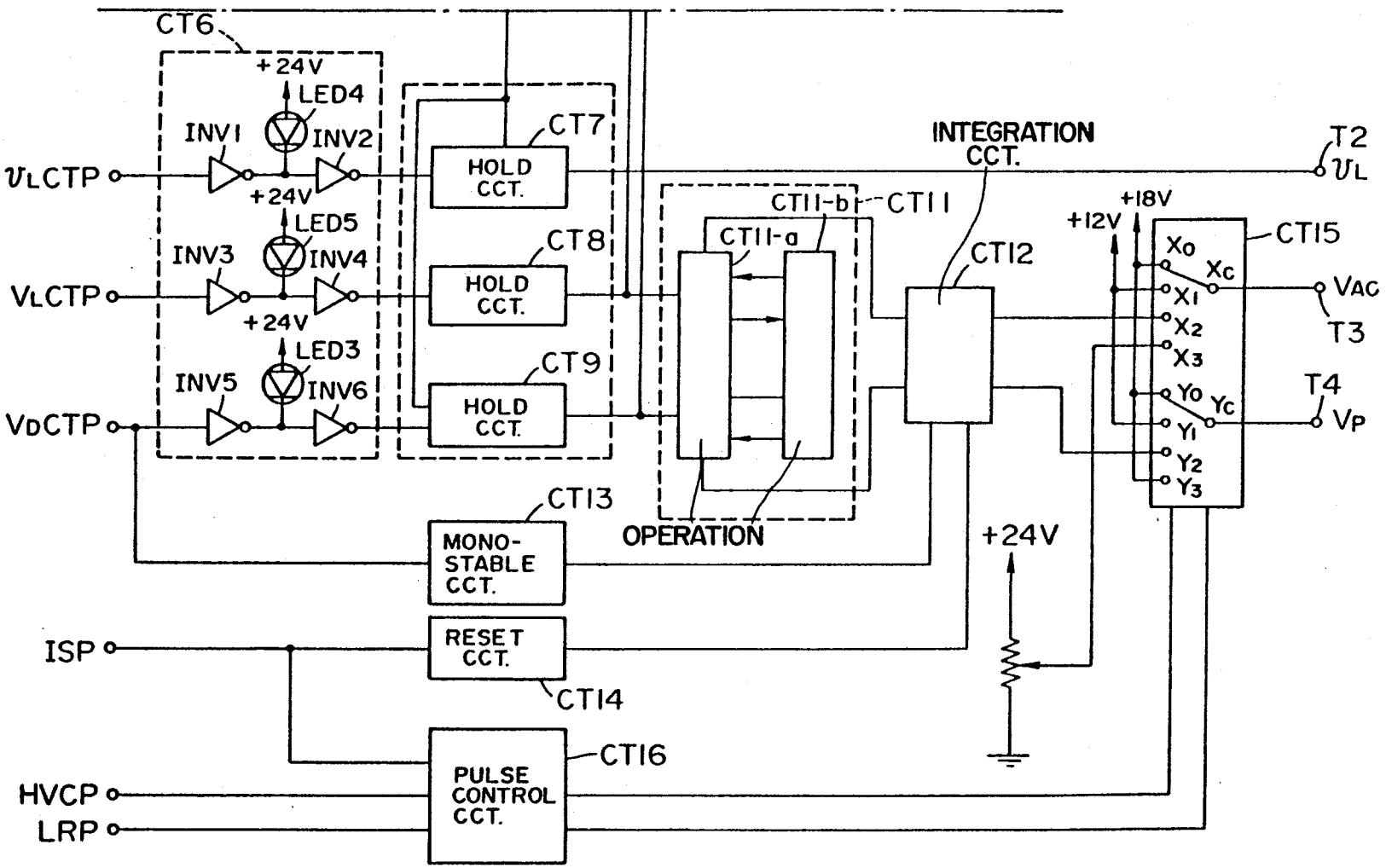

FIG. 12 diagrammatically shows a surface potential detecting and processing circuit. The operation of this circuit will be described.

Figure 13:
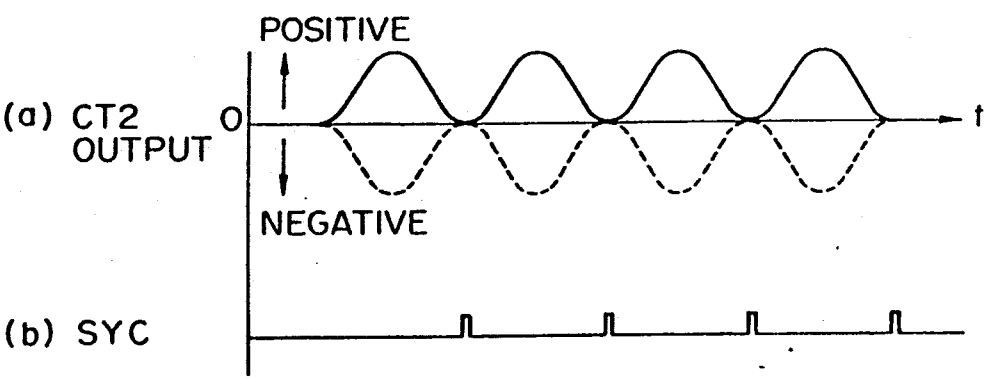
FIG. 13 shows the output waveforms of an amplifier circuit CT2 and synchronizing signal.

When a sensor motor drive signal SMD is applied from an input terminal T1, a sensor motor drive control circuit CT1 is operated to drive the sensor motor 82, which thus rotates the chopper 83. As the chopper 83 is rotated, an AC voltage having an amplitude proportional to the absolute value of the surface potential of the photosensitive drum 47 is induced in the measuring electrode 85, as already described. The said AC voltage is amplified by an amplifier circuit CT2 and applied to the input terminal of a synchronizing clamp circuit CT4. The output waveform of the amplifier circuit CT2 is shown in FIG. 13. In FIG. 13(*a*), the solid line represents the case where the surface potential is positive, and the dotted line represents the case where the surface potential is negative. FIG. 13(*b*) shows a synchronizing signal SYC generated by the light-emitting diode 84 and the photo-transistor 87. The synchronizing signal SYC is amplified by a synchronizing amplifier circuit CT3 and applied to the synchronizing clamp circuit CT4. The other output terminal of the synchronizing amplifier circuit CT3 is connected to a light-emitting diode LED6, which is turned on during the generation of the synchronizing signal to detect the rotation of the sensor motor 82. The synchronizing clamp circuit CT4 is for clamping the AC voltage from the amplifier circuit CT2 to zero volt by the synchronizing signal put out by the synchronizing amplifier circuit CT3. The timing of the clamp corresponds to the time when the chopper 83 closes the potential detecting window 89 and therefore, the output of the synchronizing clamp circuit CT4 is positive when the drum surface potential is positive, and negative when the surface potential is negative. A light-emitting diode LED1 connected to the synchronizing clamp circuit CT4 is turned on when the surface potential is positive, and a light-emitting diode LED2 is turned on when the surface potential is negative. The output signal of the synchronizing clamp circuit CT4 is applied to a smoothing circuit CT5 and converted into a DC voltage. The details of the synchronizing clamp circuit CT4 are described in U.S. application Ser. No. 956,331 filed on Oct. 31, 1978. The output signal of the smoothing circuit CT5 is applied to a standard light part surface potential $V_L$ hold circuit CT7, a light part surface potential $V_L$ hold circuit CT8 and a dark part surface potential $V_D$ hold circuit CT9. The $V_L$ detection pulse signal $V_L$CTP from a DC controller is applied to the $V_L$ hold circuit CT7 through the inverters INV1 and 2 in a pulse circuit CT6, and the $V_L$ hold circuit CT7 holds the output voltage of the smoothing circuit CT5 when the signal $V_L$ CTP is put out. The light-emitting diode LED4 in the pulse circuit CT6 is turned on when the signal $V_L$ CTP is put out. Likewise, the $V_L$ hold circuit CT8 holds the output voltage of the smoothing circuit CT5 when the $V_L$ detection signal $V_L$ CTP is put out, and a light-emitting diode LED5 is turned on when the signal $V_L$ CTP is put out. Likewise, a $V_D$ hold circuit CT9 holds the output voltage of the smoothing circuit CT5 when a $V_D$ detection signal $V_D$CTP is put out, and a light-emitting diode LED3 is turned on when the signal $V_D$ CTP is put out.

The output of the $V_L$ hold circuit CT7 is put out to an output terminal T2. The outputs of the $V_L$ hold circuit CT8 and the $V_D$ hold circuit CT9 are put out to a display circuit CT10 and an operation circuit CT11.

The display circuit CT10 receives as inputs the output of the preamplifier circuit CT2, the output of the $V_L$ hold circuit CT8 and the output of the $V_D$ hold circuit to turn on light-emitting diodes LED7 and LED8 when the surface potential contrast voltage ($V_D-V_L$) is below a predetermined voltage, thus informing that stable images cannot be obtained. The light-emitting diode LED7 sets the predetermined voltage to +500 V, for example, and is turned on when the potential contrast voltage is below 500 V, and the light-emitting diode LED8 sets the predetermined voltage to +450 V, for example, and is turned on when the potential contrast voltage is below 450 V. By these display elements, it is possible to know whether or not the surface potential is proper, even where there is no special measuring device. A light-emitting diode LED9 is a display device adapted to be turned on if a potential is produced on the drum surface, irrespective of whether the potential is of the positive or the negative polarity.

The operation circuit CT11 is a circuit which carries out the operation described in connection with the surface potential control system, and calculates current values $\Delta I_{Pn}$ and $\Delta I_{ACn}$ representing the difference between the currents $I_{Pn}$ and $I_{ACn}$ flowed to the plus charger and the AC charger during the detection of the surface potential and the control current value $I_{Pn+1}$ to be flowed next time. $\Delta I_{Pn}$ and $\Delta I_{ACn}$ may be expressed as follows:

$$\Delta I_{Pn}=I_{Pn+1}-I_{Pn}=\alpha_1\cdot\Delta V_{Dn}+\alpha_2\cdot\Delta V_{Ln}$$

$$\Delta I_{ACn}=I_{ACn+1}-I_{ACn}=\beta_1\cdot\Delta V_{Dn}+\beta_2\cdot\Delta V_{Ln}$$

The operation circuit CT11 is divided into two circuits CT11-*a* and CT11-*b*. The circuit CT11-*a* amplifies the outputs of the hold circuits CT8 and CT9 and shifts these to the light part potential $V_{Ln}$ and the dark part potential $V_{Dn}$ for operation, and the output of the circuit CT11-*a* is supplied to the circuit CT11-*b*. The circuit CT11-*b* calculates $$\alpha_1(V_{Do}-V_{Dn}) \quad (1)$$

$$\beta_1(V_{Do}-V_{Dn}) \quad (2)$$

$$\alpha_2(V_{Lo}-V_{Ln}) \quad (3)$$

$$\beta_2(V_{Lo}-V_n) \quad (4)$$

and returns these to the circuit CT11-*a*, and further calculates (1)+(3), (2)+(4), and puts out the result to an integration circuit CT12.

Figure 14:
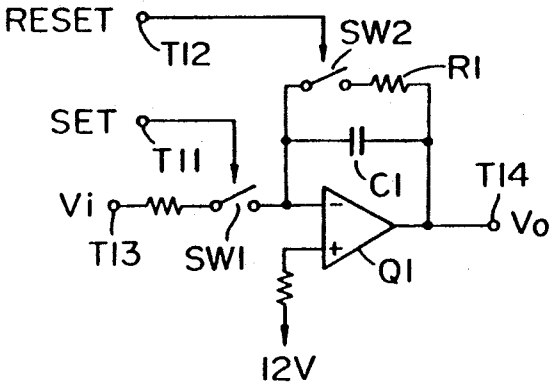
FIG. 14 diagrammatically shows an integration circuit.

The integration circuit CT12 has two circuits for controlling the primary charger and the AC charger, respectively, constructed as shown in FIG. 14.

In FIG. 14, a set signal SET is applied to a terminal T11 and a reset signal RESET is applied to a terminal T12. Switches SW1 and SW2 are analog switches. The switch SW1 is closed when the set signal SET is produced, and the switch SW2 is closed when the reset signal RESET is produced. When the dark part potential detection signal $V_D$CTP is produced, a monostable circuit CT13 is operated to close the switch SW1 and the set signal SET is applied to the minus input terminal of an operational amplifier Q1 and at the same, a capacitor C1 is charged with an input voltage $V_i$.

At this time, an initial set signal ISP is put out as it has previously been described that the initial setting is effected during condition 3 and condition 4. The set signal ISP is applied as an integration circuit reset signal to an integration circuit CT12 through a reset signal circuit CT14 to close the switch SW2. When the switch SW2 is closed, the charge in the capacitor C1 is discharged through a resistor R1 and a standard potential 12 V is put out to an output terminal T14. Since the switch SW1 remains closed only for 1/5 of the complete charging-discharging time of the capacitor C1, only 1/5 of the difference between the input voltage $v_i$ of the input terminal T13 and the standard voltage (12[V]) is charged and discharged.

Thus, elements CT11 and CT12 constitute setting means for repetitively effecting detection by detector means and correction by the output correcting means, and for setting the output of the charging device.

For example, if it is assumed that the input voltage $V_{i1}=14.5$ [V] when the first set signal SET is produced, the output voltage $V_{o1}$ may be expressed as follows:

$$V_{o1}=\frac{12-V_{i1}}{5}+12=\frac{-2.5}{5}+12=11.5\text{ [V]}$$

Thus, the output voltage $V_{o1}$ becomes 11.5 [V].

Next, if it is assumed that the input voltage $V_{i2}=9.5$ [V] when the second set signal is produced, the output voltage $V_{o2}$ likewise becomes:

$$V_{o2}=\frac{V_{o1}-V_{i2}}{5}+12=\frac{11.5-9.5}{5}+12=12.4\text{ [V]}$$

This is repeated in accordance with the number of correction times. That is, if the output voltage $V_o$ before the switch SW1 is closed is $V_{o(n-1)}$ and the next input voltage $V_i$ is $V_{in}$, the next output voltage $V_{on}$ becomes $$V_{on}=\frac{V_{o(n-1)}-V_{in}}{5}+12$$

and 1/5 of the variation is charged.

As already described, the input voltage $V_i$ corresponds to the current values $\Delta I_{Pn}$ and $I_{ACn}$ representing said difference, and the output voltage $V_o$ corresponds to the control current value $I_{Pn+1}$ or $I_{ACn+1}$.

The aforementioned output voltage $V_o$ is applied to a multiplexer circuit CT15.

The multiplexer circuit CT15 is controlled in accordance with the signal from a pulse control circuit CT16.

The pulse control circuit CT16 applies control signals as 2-bit parallel signals to the multiplexer circuit CT15, said control signals differing between the prewet or stand-by period, the initial setting period, the controlled rotation or copying period and the post-rotation period after completion of the copying. The multiplexer circuit CT15 changes its contact during each of said periods. The multiplexer circuit CT15 puts out a primary charger control voltage $V_P$ and an AC charger control voltage $V_{AC}$ from its terminals T3 and T4, respectively.

More particularly, the pulse control circuit CT16 controls the multiplexer circuit CT15 so as to change over the contacts $X_c$ and $Y_c$ thereof in accordance with the conditions of the initial set signal ISP, the high voltage control pulse HVCP and the post-rotation pulse LRP. The table below shows each pulse signal and the true values of the connected conditions of the input and the output contacts when the contacts on the input side are $X_n$ and $Y_n$ (n=0.1.2.3).

| Control Pulses | | | Contacts | |
|---|---|---|---|---|
| LRP | ISP | HVCP | $X_c$ | $Y_c$ |
| L | L | L | $X_0$ | $X_0$ |
| L | L | H | $X_2$ | $Y_2$ |
| L | H | L | $X_1$ | $Y_1$ |
| L | H | H | $X_3$ | $Y_3$ |
| H | — | — | $X_3$ | $Y_3$ |

The contents of the input side contacts $X_n$ and $Y_n$ are as follows:

| | |
|---|---|
| $X_0 = +18$ V | $Y_0 = +18$ V |
| $X_1 = +12$ V | $Y_1 = +12$ V |
| $X_2$ = Control signal | $Y_2$ = Control signal |
| $X_3 = +18$ V | $Y_3$ = Post-rotation control signal |

Figure 15:
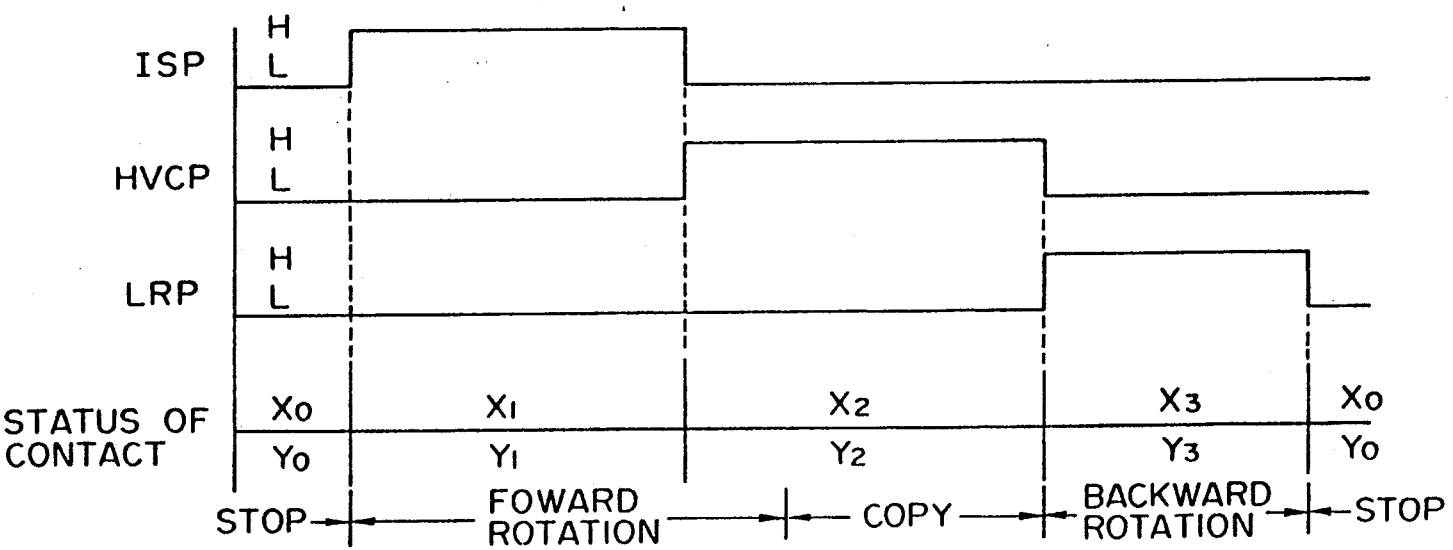
FIG. 15 is control pulse generation timing chart.

A control pulse generation timing chart is shown in FIG. 15. During stoppage of the copying, $X_c$ and $Y_c$ are connected to $X_o$ and $Y_o$, respectively. Since both $X_o$ and $Y_o$ are +18 V, the high voltage source becomes inoperative for both the primary charger and the AC charger. During the first half of the pre-rotation, $X_c$ and $Y_c$ are connected to $X_1$ and $Y_1$, respectively. Since both $X_1$ and $Y_1$ are +12 V, the high voltage source becomes operative to produce a standard current for both the primary charger and the AC charger and at this time, the surface potentiometer detects the surface potential of the drum. Next, during the second half of the pre-rotation, $X_c$ and $Y_c$ are connected to $X_2$ and $Y_2$, respectively, and when the surface potential of the drum measured during the first half of the pre-rotation is deviated with respect to the target surface potential, the amount of correction thereof is transmitted to $X_2$ and $Y_2$ and the high voltage source supplies a corrected high tension current to the chargers. This state is also maintained during the next copying stage. During the post-rotation, $X_c$ and $Y_c$ are connected to $X_3$ and $Y_3$, respectively, and since $X_3$ is +18 V, the primary charger becomes inoperative and $Y_3$ provides a post-rotation control signal to flow a predetermined corona current to the AC charger and remove any charge remaining on the drum surface.

Figure 18:
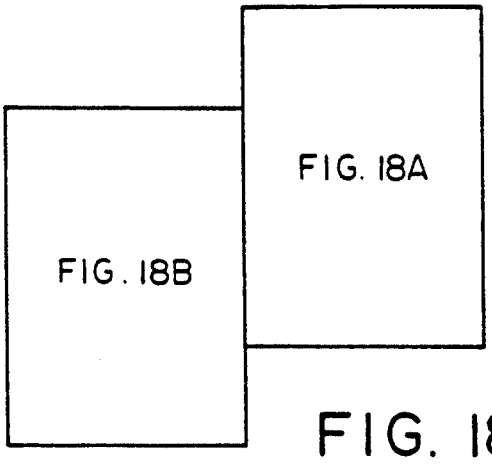
FIG. 18 comprising

The primary charger control voltage $V_P$ and the AC charger control voltage $V_{AC}$ put out by the multiplexer circuit CT15 are applied to a charger control circuit shown in FIG. 18.

At this time, when the copying is effected without the down time of more than 30 seconds intervening, as described, the charger control by the detection of the surface potential is not carried out. Even at such a time, the charger control circuit of FIG. 18 renders the current flowing through the charging high voltage source into a constant current and compensates for the load variation between the chargers and the drum resulting from environmental variations.

Before the charger control circuit of FIG. 18 is described, the principle thereof will be described.

Figure 16:
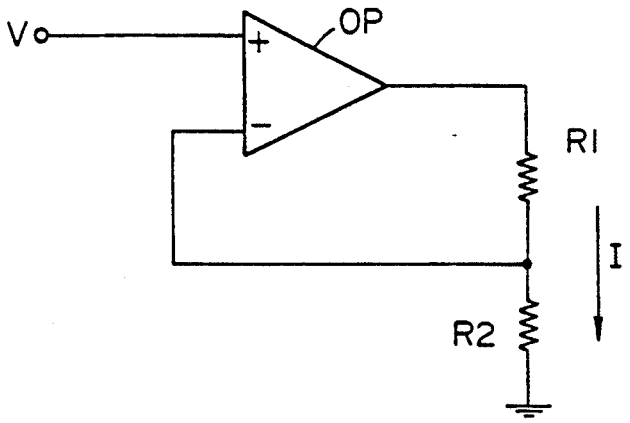
FIG. 16 is a diagram of a known constant current circuit.

A known constant current circuit is shown in FIG. 16. In FIG. 16, when an input voltage V is applied to one input terminal of an operational amplifier OP, the current I flowing through a resistor $R_1$ is determined by $I = V/R_2$. That is, even if the value of the resistor $R_1$ is varied, the current flowing through the resistor $R_1$ is constant if the input voltage is constant.

Figure 17:
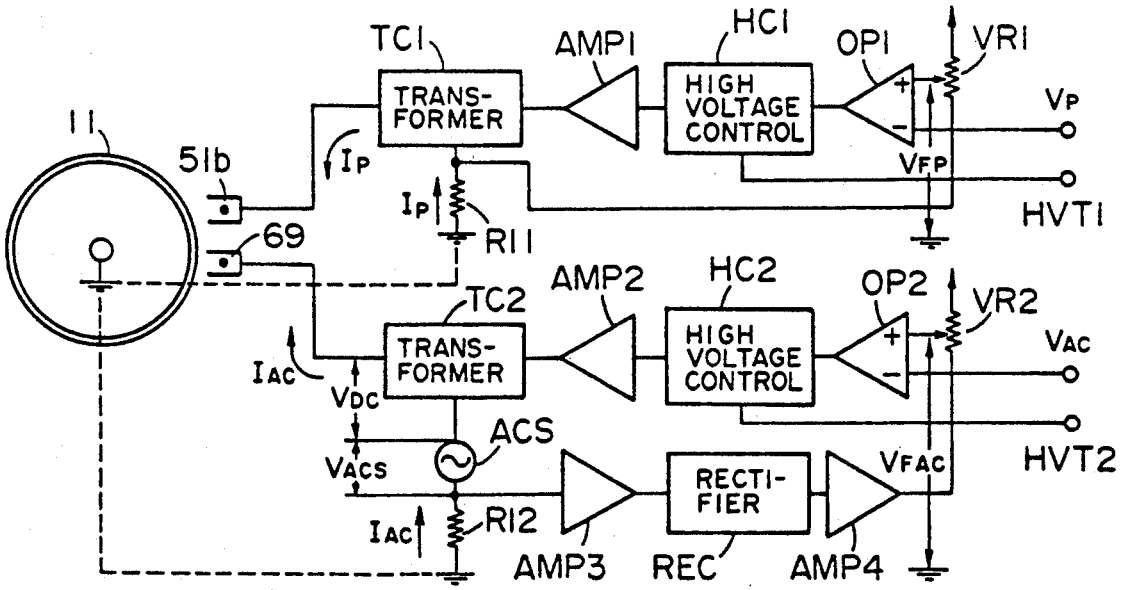
FIG. 17 is a simple block diagram of a charger control circuit.

FIG. 17 shows a simple block diagram of the charger control circuit using the constant current circuit as shown in FIG. 16.

The primary charger control voltage $V_P$ and AC charger control voltage $V_{AC}$ put out by the multiplexer CT15 are applied to the inverting input terminals of operational amplifiers $OP_1$ and $OP_2$, respectively. Voltages determined by resistors $VR_1$ and $VR_2$ are applied to the non-inverting input terminals of the operational amplifiers $OP_1$ and $OP_2$ and compared with the voltages applied to the inverting input terminals and amplified. When a primary charger driving signal $HVT_1$ is put out, the signal $HVT_1$ is applied to a primary high voltage control circuit $HC_1$, which delivers the output of the operational amplifier $OP_1$ to an amplifier $AMP_1$. Likewise, when an AC charger driving signal $HVT_2$ is put out, the signal $HVT_2$ is applied to an AC high voltage control circuit $HC_2$, which delivers the output of the operational amplifier $OP_2$ to an amplifier $AMP_2$. The output of the amplifier $AMP_1$ increases or decreases the output voltage of a primary charger high voltage transformer $TC_1$. Likewise, the output of the amplifier $AMP_2$ controls the output voltage of an AC charger transformer $TC_2$.

The primary corona current $I_P$ following through the primary charger 51 and the AC corona current $I_{AC}$ flowing through the AC charger 69 are detected by resistors $R_{11}$ and $R_{12}$, respectively, and the primary high voltage transformer TC1 flows the primary corona current $I_P$ until a voltage $V_{FP}$ determined by resistors $R_{11}$ and $VR_1$ and the primary charger control voltage $V_P$ become coincident with each other, and when the voltage $V_{FP}$ becomes coincident with the primary control voltage $V_P$, the primary corona current $I_P$ is controlled to a constant value unless the primary control voltage $V_P$ is varied. Likewise, the AC high voltage transformer $TC_2$ flows the AC corona current $I_{AC}$ until a voltage $V_{FAC}$ determined by resistors $R_{12}$ and $VR_2$ becomes coincident with the AC charger control voltage $V_{AC}$, and when the voltage $V_{FAC}$ becomes coincident with the AC control voltage $V_{AC}$, the AC corona current $I_{AC}$ is controlled to a constant value unless the AC control voltage $V_{AC}$ is varied. That is, both the primary and the AC corona current are controlled to constant values unless the next measurement of the surface potential is effected. Also, when a time has elapsed and the detection of the surface potential is again effected and the surface potential is not proper, then the corona current is again controlled. The control of the surface potential may be effected by controlling the corona current after the portion of the photosensitive medium to which the previously corrected corona current has been flowed is measured or by controlling the corona current after the portion of the photosensitive medium to which the initially set corona current has again been flowed is measured.

Since the AC charger is an alternating current charger, a voltage comprising the AC voltage $V_{ACS}$ of the AC voltage source ACS having a DC output voltage $V_{DC}$ superimposed thereon is applied to the AC charger. That is, constant current difference control is effected in which the AC voltage $V_{ACS}$ is constant and only the DC output voltage $V_{DC}$ is controlled by the AC charger control voltage $V_{AC}$. Therefore, the AC corona current $I_{AC}$ detected by the resistor $R_{12}$ is amplified by an amplifier AMP3, where after the difference between the positive and the negative component, namely, the DC component alone is detected by a smoothing circuit REC and amplified by a DC amplifier AMP4 and applied to the resistor $VR_2$.

Figure 18A:
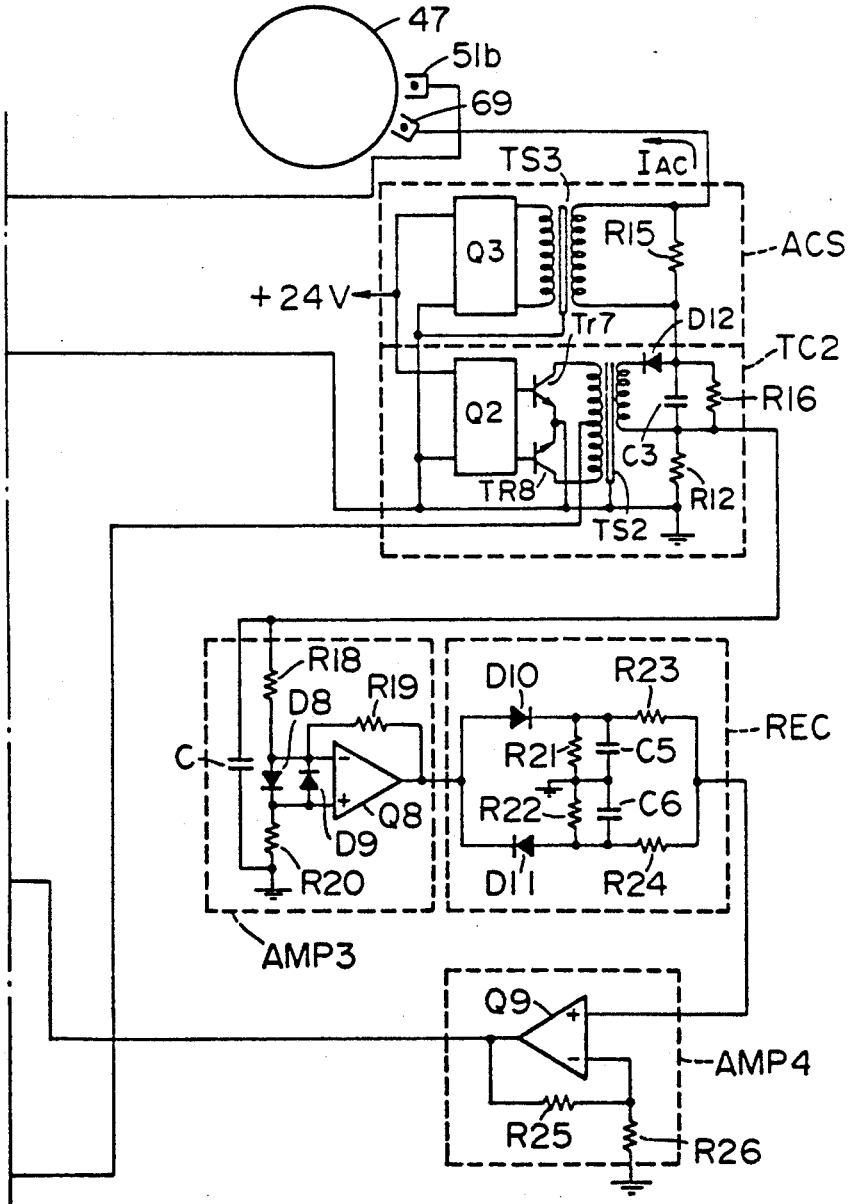
FIGS. 18A and 18B, is a diagram of the charger control circuit.
Figure 18B:
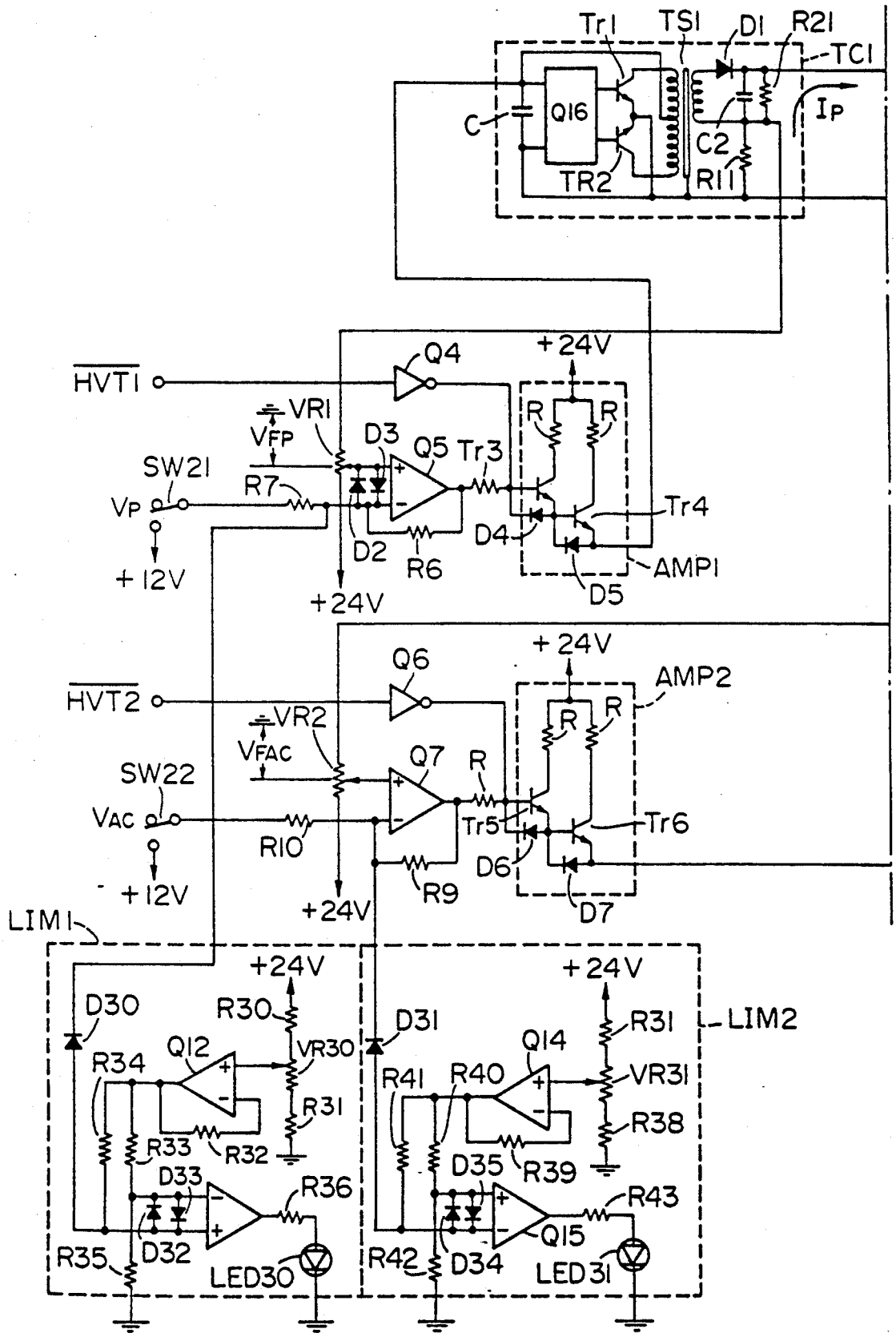

FIGS. 18A and B shows the actual charger control circuit of the block diagram of FIG. 17.

The charger control circuit will now be described. The primary charger control voltage $V_P$ is applied to the inverting input terminal of an operational amplifier Q5 through a resistor $R_7$. The differential voltage between the voltage $V_{FP}$ applied from a resistor VR1 to the non-inverting input terminal of the operational amplifier Q5 and the control voltage $V_P$ is multiplied by $-R_6/R_7$, and put out by the operational amplifier Q5. When the inverted signal $\overline{HVT1}$ of the primary charger driving signal HVT1 is "H", the output of the operational amplifier Q5 is clamped to 0 by the input of a Darlinton current amplifier AMP1. That is, the output of the Darlinton current amplifier AMP1 is 0. When said signal $\overline{HVT1}$ is "L", substantially the same voltage as the output voltage of the operational amplifier Q5 in put out to the primary high voltage transformer TC1. The oscillator Q16 in the primary transformer TC1 turns on transistors Tr1 and Tr2 alternately. The transformer TS1 boosts on the secondary side thereof in accordance with the number of turns ratio, and the secondary output thereof is rectified by a diode D1 and applied to the primary charger 51. The primary corona current $I_P$ flowing through the primary charger 51 is detected by the resistor $R_{11}$ and applied to the non-inverting input terminal of the operational amplifier Q5 through a resistor VR1, and the primary corona current $I_P$ is controlled so that the voltage $V_{FP}$ and the primary charger control voltage $V_P$ become coincident with each other. Likewise, the AC charger control voltage $V_{AC}$ is applied to the inverting input terminal of an operational amplifier Q7 through a resistor R10. The differential voltage between the voltage $V_{FAC}$ applied from a resistor VR2 to the non-inverting input terminal of an operational amplifier Q7 and the control voltage $V_{AC}$ is multiplied by $-R_9/R_{10}$ and put out by the operational amplifier Q7. When the inverted signal $\overline{HVT2}$ of the AC charger driving signal HVT2 is "H", the output of the operational amplifier Q7 is clamped to O by the input of a Darlinton current amplifier AMP2. That is, the output of the Darlinton current amplifier AMP2 is O. When said signal $\overline{HVT2}$ is "L", substantially the same voltage as the output voltage of the operational amplifier Q7 is put out to an AC high voltage transformer TC2. The oscillator Q2 in the secondary high voltage transformer TC2 turns on transistors $T_{r7}$ and $T_{r8}$ alternately. The transformer TS2 boosts on the secondary side thereof in accordance with the number of turns ratio, and the secondary side output thereof is rectified by a diode D12 and the DC component is taken out as the output. An AC voltage generator ACS puts out an AC high voltage with the aid of the AC oscillator Q3 and the transformer TS2 and puts out to the secondary charger 69 the AC high voltage having the DC component output superimposed thereon. The AC corona current $I_{AC}$ flowing through the AC charger is detected by a resistor R12. The detection output is amplified by an amplifier AMP3, where after only the DC component of the AC corona current $I_{AC}$ is detected by the smoothing circuit REC and amplified by a DC amplifier AMP4. Further, said detection output, after being amplified by said amplifier AMP4, is applied to the non-inverting input terminal of the operational amplifier Q7 through a resistor VR2 to control the AC corona current $I_{AC}$ so that said voltage $V_{FAC}$ and said AC control voltage $V_{AC}$ become coincident with each other, as already described.

Figure 19:
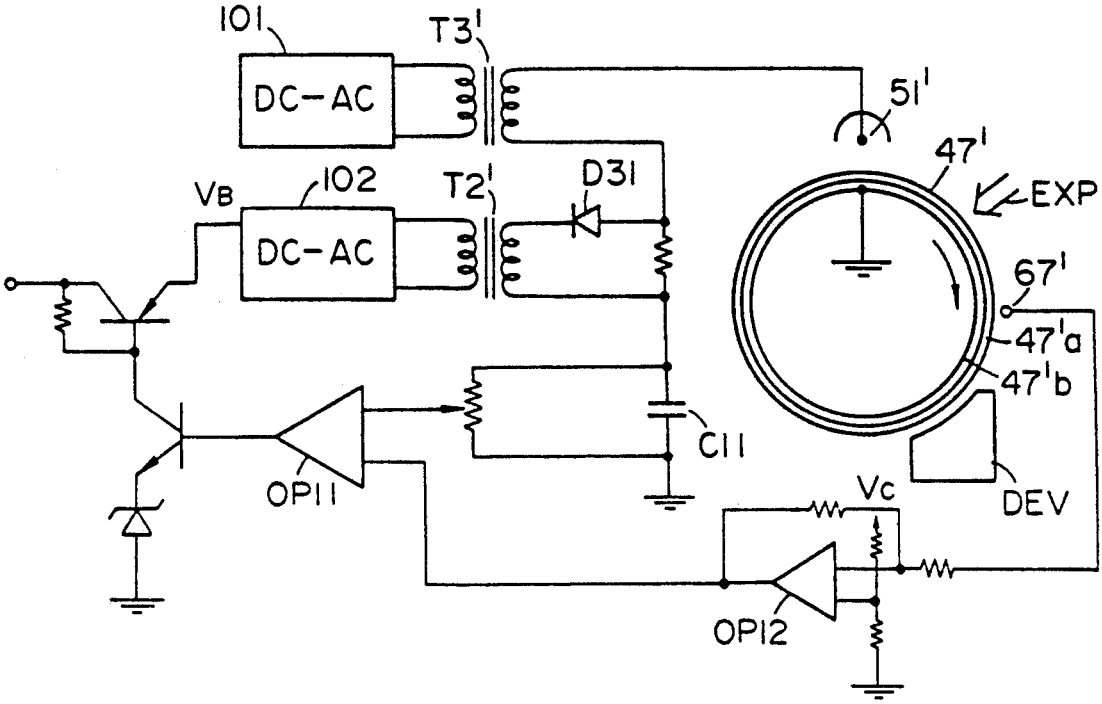
FIG. 19 is a diagram of another charger control circuit.

FIG. 19 shows another embodiment of the present invention. In FIG. 19, reference numeral 101 forms a fixed output DC-AC inverter with a transformer T3' and reference numeral 102 forms a variable output DC-AC inverter with a transformer T2'. FIG. 19 further includes a two-layer photosensitive medium 47' having a photoconductive layer 47'*a* and a conductive layer 47'*b*, a current difference detecting capacitor C11, a reflected light EXP from an unshown original, a surface potentiometer 67', a developing unit DEV, operational amplifiers $OP_{11}$ and $OP_{12}$, and a rectifying diode D31.

The reflected light EXP removes the charge formed on the photoconductive layer 47'*a* by a charger 51' and forms on the photoconductive layer 47'*a* a latent image corresponding to the original image. The latent image is developed by the developing unit DEV and the developed image is transferred to transfer paper by a transfer unit, not shown. The surface potentiometer 67' measures the surface potential of the drum 47' and the measured surface potential is applied to one input terminal of the operational amplifier $OP_{12}$. A standard voltage corresponding to the standard surface potential is applied to the other input terminal of the operational amplifier $OP_{12}$, which amplifies and puts out the difference between the standard voltage and the surface potential detection output voltage. The output of the operational amplifier $OP_{12}$ is put out to one input terminal of the operational amplifier $OP_{11}$, and the output from a current difference detecting capacitor to be described is applied to the other input terminal of the operational amplifier $OP_{11}$.

The operational amplifier $OP_{11}$ puts out its output so that the output of the operational amplifier $OP_{12}$ becomes coincident with the output of the current difference detecting capacitor C11. That is, the operational amplifier $OP_{11}$ operates so that the current difference is varied in accordance with the output of the operational amplifier $OP_{12}$.

The output of the operational amplifier $OP_{11}$ varies the DC shift component of the AC voltage put out by the transformer T2' and applied to the charger 51. The transformer T3' puts out a high AC voltage of the order of 100 Hz.

The superimposed voltages of the transformer's T2' and T3' are applied to the charger 51'. A charge corresponding to the current representing the difference between the positive and the negative component of the current flowing through the charger 51' is stored in the capacitor C11, and a voltage corresponding to the stored charge is fed back to the operational amplifier $OP_{11}$. The operational amplifier $OP_{11}$ controls a variable output DC-AC inverter so that the output of the capacitor C11 becomes equal to the output of the operational amplifier $OP_{12}$. Thus, it is possible to maintain a desired corona current corresponding to the standard value set by the surface potentiometer.

In the present embodiment, as described above, the value of the corona current is controlled to a constant value by the detection output of the surface potentiometer and the corona current detection output and therefore, it is possible to correct any variation in the charger load or any variation in the power source of the corona discharging device resulting from temporary environmental variations and maintain the corona current at a constant value and it is also possible to correct any variation in surface potential for the corona current resulting from a variation with time such as deterioration of the drum. Accordingly, the measurement of the surface potential need not be effected each time but may be effected at the order of one time per several tens of sheets or several hundred sheets and this may prevent the reduction in the image formation processing speed which would otherwise be involved in the measurement of the surface potential.

Whenever the potentiometer 67 or the potential detecting circuit has gone wrong, the input voltage may be set to a predetermined voltage irrespective of the control voltages $V_P$ and $V_{AC}$ by changing over switches $SW_{21}$ and $SW_{22}$ (FIGS. 18A and B). Further, in the embodiment, limiter circuits LIM1 and LIM2 as output limiting means are provided to prevent occurrence of accidents. The operation of the limiter circuits LIM1 and LIM2 will now be described. An operational amplifier Q14 and a resistor R39 together constitute a buffer circuit, and a voltage resulting from dividing the source voltage by resistors R31 and R38 and a variable resistor VR31 is obtained at the output of the operational amplifier Q14. An operational amplifier Q7 is an inverter, and the high voltage output current increases if the AC charger control voltage $V_{AC}$ drops. Therefore, by adjusting the variable resistor VR31, the output voltage of the operational amplifier Q14 is set to a value higher by 0.6 V than the minimum value $V_{ACMIN}$ of the AC charger control voltage $V_{AC}$ corresponding to a maximum current flowing through the AC charger. If the AC charger control voltage $V_{AC}$ tries to drop below the minimum value $V_{ACMIN}$, the diode D31 is turned on and the control signal $V_{AC}$ is connected to the output of Q14 through a resistor R10 and a low resistor R41. The output of Q14 is almost constant and if the resistor R41 is sufficiently small with respect to R10, the high voltage output current is not increased any further and the limiters act. When the diode D31 is turned on and the limiters are acting, a comparator 15 is inverted to turn on LED31 and enable the operation of the limiters to be confirmed. The operating mechanism of the limiter circuit LIM1 of the primary charger is entirely similar to the operation of the limiter circuit LIM2 of the AC charger. The limiter circuits are provided in order to prevent the corona current of each charger from becoming abnormally great. It is because the target surface potential has not been reached even if a predetermined current flows to the primary charger and the AC charger that the limiter circuits LIM1 and LIM2 are operated, and such situation occurs particularly when the drum is deteriorated. Accordingly, light-emitting diodes LED30 and LED31 providing informing means, display the operation of the limiter circuit LIM1 and at the same time monitors the deterioration of the drum. Also, when the electrode of the charger is too close to the drum surface, or when foreign material such as paper or the like comes into between the charger and the drum surface, or when the electrode of the charger is broken and comes into contact with the drum surface, the electrode of the charger effects not a corona discharge but a glow discharge. Then, an excessive current may flow to damage the drum surface. Such disadvantage may be prevented by the provision of the limiter circuits.

Figure 20:
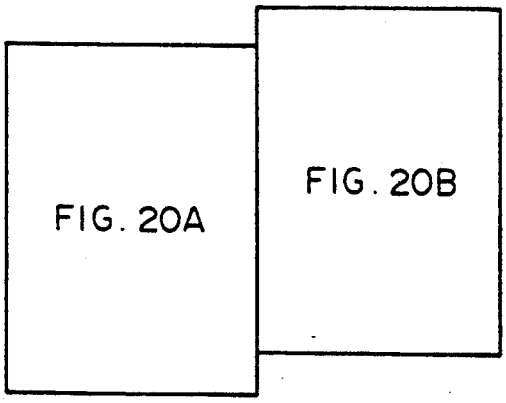
FIG. 20 comprising
Figure 20A:
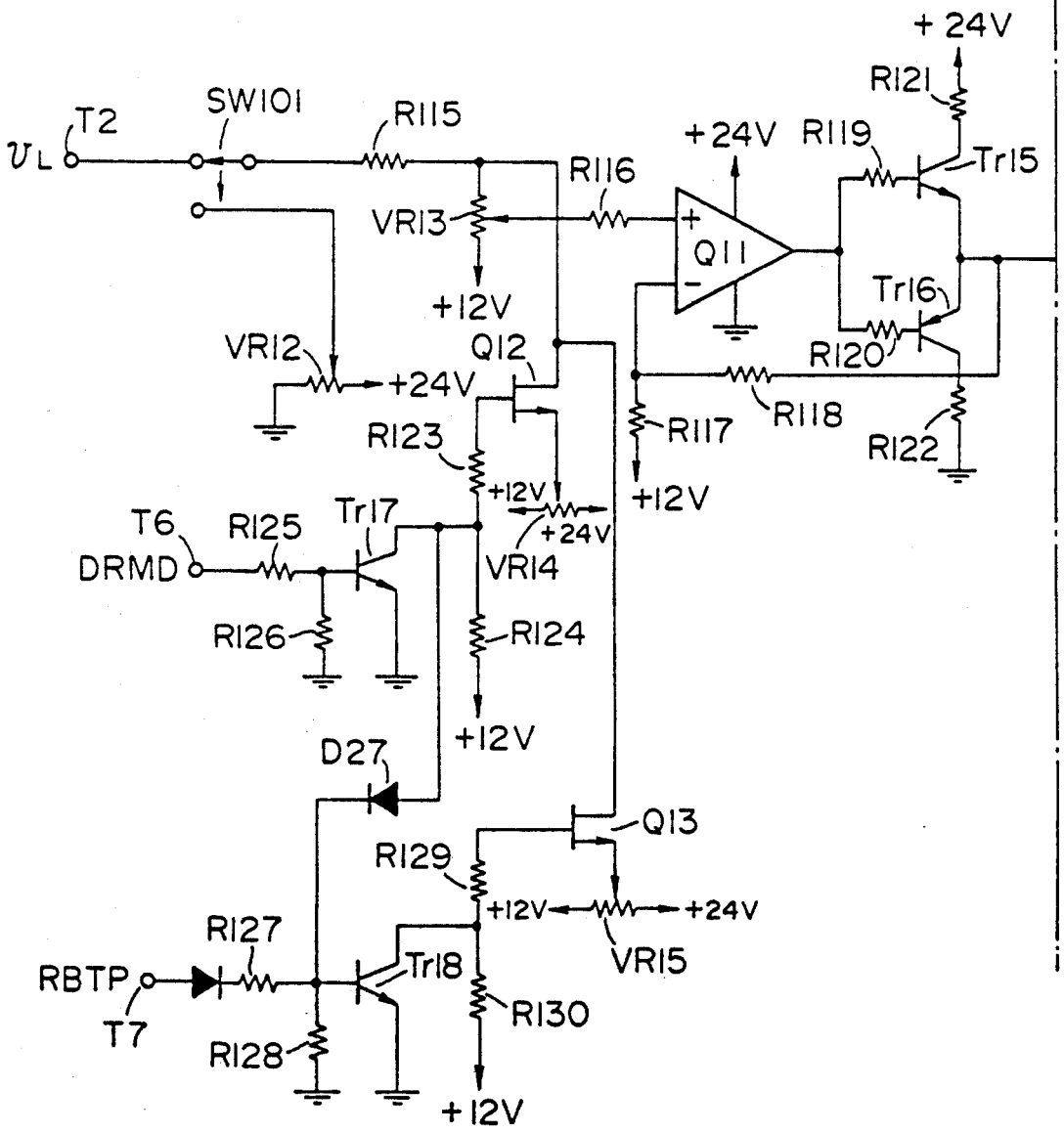
FIGS. 20A and 20B, is a diagram of a developing bias control circuit.
Figure 20B:
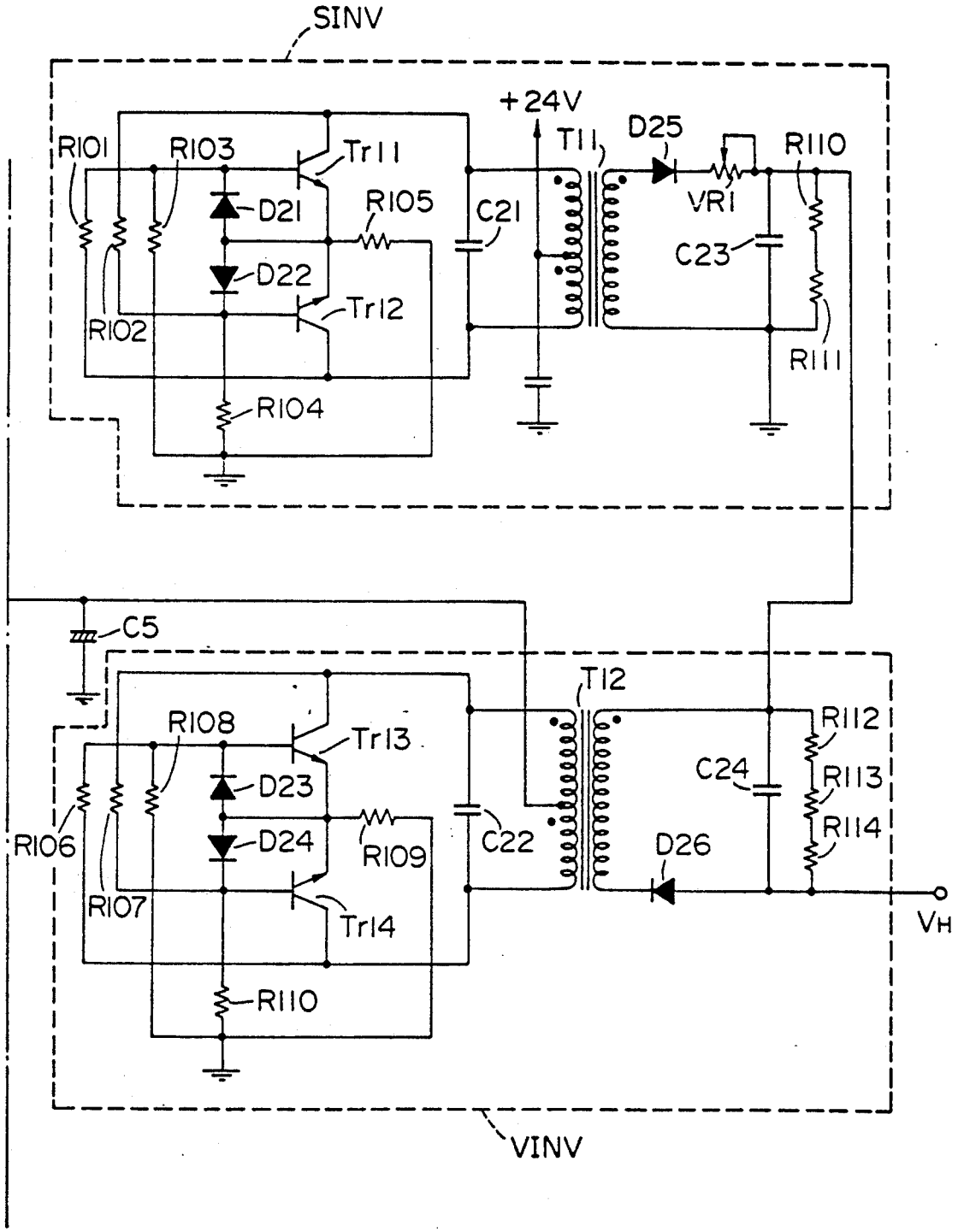

A control circuit for controlling a developing roller bias voltage $V_H$ will now be described with reference to the circuit diagram of FIGS. 20A and B.

The output of the $V_L$ hold circuit CT7 is applied to a terminal T2. A main motor drive signal DRMD representing the drum rotation is applied to a terminal T6, and a roller bias control signal RBTP which generates a latent image corresponding to the original during development is applied to a terminal T7. Since both the signals DRMD and RBTP are "H" during the drum rotation and during the development of the latent image, transistors $T_{r17}$ and $T_{r18}$ are turned on and the gates of depression type junctions FET Q12 and Q13 become OV, so that both FET Q12 and Q13 are turned off. Therefore, the signal applied to an operational amplifier Q11 is the aforementioned output voltage $V_L$ passed through resistors R115 and VR13. The output of the operational amplifier Q11 is applied to a predetermined point of a transformer T12 through a current booster comprising transistors $T_{r15}$ and $T_{r16}$, and the developing bias voltage $V_H$ is varied in accordance with the output voltage $V_L$ by inverter circuits VINV and SINV which will later be described. At this time, the developing bias voltage $V_H$ is controlled by the inverter circuits SINV and VINV so that it becomes +50 V with respect to the standard light part potential on the drum. Also, when the development of the latent image is not effected during the drum rotation, the signal DRMD becomes "H" and the signal RBTP becomes "L", so that transistor $T_{r17}$ is turned on and transistor $T_{r18}$ is turned off and therefore, said FET Q12 is turned off and said FET Q13 is turned on. When said FET Q13 is turned on, a predetermined voltage determined by a variable resistor VR15 is applied to the operational amplifier Q11 and a fixed voltage corresponding to said predetermined voltage is applied to a transformer T12 through said current booster. At this time, the predetermined voltage determined by the variable resistor VR15 is set to such a value that the bias voltage $V_H$ becomes −75 V. When development is not occurring during the drum rotation, adherence of developer to the drum is prevented. When the drum is not rotating, both the signals DRMD and RBTP are "L". At such time, the transistor $T_{r17}$ is turned off and the transistor $T_{r18}$ is turned on through a diode D27, so that said FET Q12 is turned on and said FET Q13 is turned off. When the FET Q12 is turned on, a predetermined voltage determined by a variable resistor VR14 is applied to the operational amplifier Q11 and a fixed voltage corresponding to said predetermined voltage is applied to a transformer T12 through said current booster.

At this time, the predetermined voltage determined by the variable resistor VR14 is set to such a value that the developing bias voltage $V_H$ becomes OV (earth potential). When the drum is not rotating, this prevents the liquid developer having a charge from being stagnant.

As described above, the developing roller bias voltage $V_H$ is varied in accordance with the controlled condition and the bias voltage is controlled by the surface potential detection output during the development of the latent image and therefore, more stable development has become possible. Description will now be made of the operation of the fixed voltage output inverter transformer circuit SINV (hereinafter referred to as the fixed inverter circuit) and the variable output inverter transformer circuit VINV (hereinafter referred to as the variable inverter circuit).

The circuit operation of the fixed inverter circuit SINV will first be described. When the power is supplied to a predetermined point of the primary winding of a transformer T11, one of transistors $T_{r11}$ and $T_{r12}$ begins to conduct. If the transistor $T_{r11}$ conducts, the collector current of this transistor is increased, so that a counter electromotive force corresponding to the increment of the collector current is produced in the coil on the collector side of the transistor $T_{r12}$ to bring the base potential of the transistor $T_{r11}$ to the positive. Thus, the collector current of the transistor $T_{r11}$ is further increased. That is, a positive feedback is exerted on the transistor $T_{r11}$ and the collector current of the transistor $T_{r11}$ is increased at a time constant determined by the inductance of resistors R103, R104 and transformer T11. A common emitter resistor R105 is connected to the emitters of the transistors $T_{r11}$ and $T_{r12}$, and when the emitter potential of the transistor $T_{r11}$ rises and approaches $$(\text{collector potential of } T_{r11}) \times \frac{R103}{R103 + R101}$$

with the increase of the collector current of the transistor $T_{r11}$, supply of the base current becomes impossible so that the collector current of the transistor $T_{r11}$ is saturated. When the collector current of the transistor $T_{r11}$ is saturated, the counter electromotive force of the primary side coil of the transformer T11 becomes O and the transistor $T_{r11}$ is turned off to decrease the collector current, and a counter electromotive force corresponding to the decrement of the collector current is generated in the primary side coil of the transformer T11 to turn on the transistor $T_{r12}$. Thereafter, the transistors $T_{r11}$ and $T_{r12}$ are repetitively turned on and off alternately. Diodes D21 and D22 are for protecting the bases of the transistors $T_{r11}$ and $T_{r12}$.

A resistor R105 is for preventing irregularity of the collector current which would otherwise result from the irregularity of the parameter $h_{FE}$ of the transistors $T_{r11}$ and $T_{r12}$ and for preventing the duty ratio of the oscillation from becoming other than 1:1. The oscillation amplitude of the voltage induced in the primary side coil of the transformer T11 is about double the voltage applied to the mid-point of the transformer T11. The voltage induced in the primary side coil is boosted to a voltage determined by the number of turns of the transformer T11 and rectified and smoothed by a diode D25 and a capacitor C23, and is put out as the DC high voltage.

The operation of the variable inverter circuit VINV is substantially similar to that of the fixed inverter circuit SINV, but since the voltage supplied to the mid-point of the transformer T12 is varied in accordance with the input signal, the output voltage of the transformer T12 is varied in accordance with the input signal.

Figure 21:
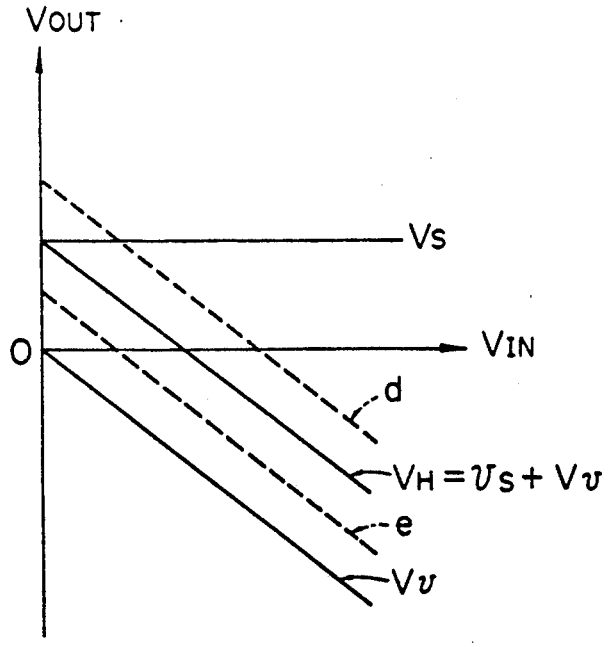
FIG. 21 shows the waveform of a high output voltage.

FIG. 21 shows a high output voltage. In FIG. 21, the ordinate represents the high output voltage Vout and the abscissa represents the input voltage Vin applied to a predetermined point of the transformer T12. The output voltage $V_s$ from the fixed inverter circuit SINV is always constant with respect to the input voltage Vin, and the output voltage $V_v$ of the variable inverter circuit is linearly varied with respect to the input voltage Vin. Accordingly, the actual developing bias voltage $V_H$ having the output voltages $V_s$ and $V_v$ superimposed thereon is linearly varied from the positive to the negative with respect to the input voltage. The output voltage $V_s$ of the fixed inverter circuit SINV is variable by adjusting the variable resistor $VR_1$ and the output voltage $V_H$ may also be shifted as indicated at (d) and (e) in FIG. 18.

Thus, it has become possible to linearly vary the developing bias voltage $V_H$ from the positive to the negative and therefore, even if the latent image potential of the photosensitive medium corresponding to the background of the original is positive, the control thereof becomes easy and moreover, the use of the inverter circuits as described above leads to the compactness of the apparatus.

As described above, a high voltage output ranging over the opposite polarities can be obtained very simply and the use of inverter transformers leads to the provision of a compact high voltage generator.

The present invention is not restricted to the embodiments described above, but covers improvements and changes included in the appended claims.

What we claim is:

1. An image forming apparatus comprising:

illuminating means;

a high adjusting circuit for manually adjusting the quantity of light of said illuminating means between a maximum quantity of light and a minimum quantity of light, and for setting a standard quantity of light intermediate the maximum and minimum quantities;

means for forming on a recording medium an image corresponding to an original illuminated by said illuminating means;

a test sample of predetermined optical density arranged to be illuminated by said illuminating means so as to produce test light for projection onto the recording medium;

detection means for detecting a surface condition related to an electrical parameter of said recording medium at a portion thereof onto which said test light has been projected;

control means for controlling said image forming means so as to regulate an image forming condition in accordance with a result of said detection by said detection means; and a switch for selecting the standard quantity of light for illumination of the test sample, and for selecting the manually-adjusted quantity of light for illumination of the original.

2. An image forming apparatus according to claim 1, wherein said illuminating means comprises a lamp which is movable relative to the original.

3. An image forming apparatus according to claim 2, wherein said lamp is positionable for illuminating the test sample.

4. An image forming apparatus according to claim 2 or 3, wherein said lamp is movable relative to the original for scan-illuminating the original for image formation.

5. An image forming apparatus according to any one of claims 1 or 3, wherein the test sample is adapted and arranged to produce said test light by reflection of light from the illuminating means.

6. An image forming apparatus according to any one of claims 1–3, wherein in operation the test sample is illuminated before illumination of the original.

7. An image forming apparatus according to any one of claims 1 or 3, wherein said image forming means comprises developing means, and said control means is arranged to control a developing bias voltage applied to said developing means, in accordance with an output of said detection means.

8. An image forming apparatus according to any one of claims 1–3, wherein in use said detection means detects said surface condition of said portion receiving said test light prior to an initial image formation.

9. An image forming apparatus according to any one of claims 1–3, wherein in use said detection means does not detect said surface condition during a process of continuously performed image formations.

10. An image forming apparatus comprising:

electrostatic latent image forming means for forming an electrostatic latent image by means of exposure after charge of a photosensitive member;

developing means for developing the electrostatic latent image formed on said photosensitive member;

measuring means for measuring a surface potential on said photosensitive member; and control means for correcting an operational condition of said electrostatic latent image forming means based on the surface potential measured by said measuring means so as to be close to a target value prior to initiation of an image formation cycle, thereby providing optimum amount of charge of said photosensitive member, said control means effecting said correction a plurality of times;

wherein in the case where an image formation cycle is begun within a predetermined time after completion of the preceding image formation cycle, said control means performs said correction a first number of times, and in the case where an image formation cycle is begun after said predetermined time, said control means performs said correction a second number of times which is more than said first number of times.

11. An apparatus according to claim 10 wherein said control means is provided with storage means for storing correction data for the operational condition of said electrostatic latent image forming means, which data is obtained by said control.

12. An apparatus according to claim 11 wherein in case the time which elapses after completion of a preceding image formation cycle is shorter than said predetermined time, said control means sets an operational condition of said electrostatic latent image forming means based on the correction data stored in said storage means at the time of initiation of said control, and controls an operational condition of said electrostatic latent image forming means to the present image formation in accordance with the value measured by said measuring means under the thus set operational condition of said electrostatic latent image forming means.

13. An apparatus according to claim 10, 11 or 12 wherein in case the time which elapses after completion of a preceding image formation cycle is longer than said predetermined time, said control means sets an operational condition of said electrostatic latent image forming means based on a predetermined initial data at the time of initiation of said control, and controls an operational condition of said electrostatic latent image forming means to the present image formation in accordance with the value measured by said measuring means under the thus set operational condition of said electrostatic latent image forming means.

14. An apparatus according to claim 10, 11 or 12 wherein said electrostatic latent image forming means includes charging means for charging said photosensitive member, and said control means corrects an operational condition of said charging means based on a value measured by said measuring means, thereby controlling the amount of charge of said photosensitive member.

15. An apparatus according to claim 14 wherein said control means corrects charging current of said charging means.

16. An apparatus according to claim 10, 11 or 12 further comprising exposure means for exposing said photosensitive member, wherein said control means provides such a control that optimum amount of charge of said photosensitive member is provided based on values measured by said measuring means as to a light surface potential and a dark surface potential on a light area and a dark area formed by means of turning on and off of said exposure means, respectively.

17. An apparatus according to claim 16 wherein said exposure means erases charge of non-image area of said photosensitive member.

18. An image forming apparatus comprising:

electrostatic latent image forming means for forming an electrostatic latent image by means of exposure after charge of a photosensitive member;

developing means for developing the electrostatic latent image formed on said photosensitive member;

measuring means for measuring a surface potential on said photosensitive member; and control means for correcting an operational condition of said electrostatic latent image forming means based on the surface potential measured by said measuring means so as to close to a target value prior to initiation of an image formation cycle, thereby providing optimum amount of charge of said photosensitive member, said control means effecting said correction of plurality of times;

wherein in the case where an image formation cycle is begun within a first time after completion of the previous image formation cycle, the control means does not perform the correction, in the case where an image formation cycle is begun with a period from the first time to a second time after completion of the previous image formation cycle, the control means performs the correction a first number of times, and in the case where an image formation cycle is begun within a period from the second time to a third time after completion of the previous image formation cycle, the control means performs the correction a second number of times.

19. An apparatus according to claim 18 wherein said control means is provided with storage means for storing correction data for the operational condition of said electrostatic latent image forming means, which data is obtained by said control.

20. An apparatus according to claim 19 wherein in the case where an image formation cycle is begun within the first time, said control means sets an operational condition of said electrostatic latent image forming means to the present image formation based on the correction data stored in said storage means.

21. An apparatus according to claim 19 or 20 wherein in the case where an image formation cycle is begun within a period from the first time to the second time, said control means sets an operational condition of said electrostatic latent image forming means based on the correction data stored in said storage means at the time of initiation of said control, and controls an operational condition of said electrostatic latent image forming means to the present image formation in accordance with the value measured by said measuring means under the thus set operational condition of said electrostatic latent image forming means.

22. An apparatus according to claim 21 wherein in the case where an image formation cycle is begun within a period from the second time to the third time, said control means sets an operational condition of said electrostatic latent image forming means based on a predetermined initial data at the time of initiation of said control, and controls an operational condition of said electrostatic latent image forming means to the present image formation in accordance with the value measured by said measuring means under the thus set operational condition of said electrostatic latent image forming means.

23. An apparatus according to claim 19 or 20 wherein in the case where an image formation cycle is begun within a period from the second time to the third time, said control means set an operational condition of said electrostatic latent image forming means based on a predetermined initial data at the time of initiation of said control, and controls an operational condition of said electrostatic latent image forming means to the present image formation in accordance with the value measured by said measuring means under the thus set operational condition of said electrostatic latent image forming means.

24. An apparatus according to claim 18, 19 or 20 wherein said electrostatic latent image forming means includes charging means for charging said photosensitive member, and said control means corrects an operational condition of said charging means based on value measured by said measuring means, thereby controlling the amount of charge of said photosensitive member.

25. An apparatus according to claim 24 wherein said control means corrects charging current of said charging means.

26. An apparatus according to claim 18, 19 or 20 further comprising exposure means for exposing said photosensitive member, wherein said control means provides such a control that an optimum amount of charge of said photosensitive member is provided based on values measured by said measuring means as to a light surface potential and a dark surface potential on a light area and a dark area formed by means of turning on and off said exposure means, respectively.

27. An apparatus according to claim 26 wherein said exposure means erases charge of non-image area of said photosensitive member.

* * * * *